US005654133A

United States Patent [19]

Oikawa

[11] Patent Number: 5,654,133

[45] Date of Patent: Aug. 5, 1997

[54] PREPARATION OF HIGH CHLORIDE CONTENT (100) TABULAR GRAINS HAVING CORNER DEFECTS

[75] Inventor: Tokuju Oikawa, Kanagawa, Japan

[73] Assignee: Fuji Photo Film Co., Ltd., Kanagawa, Japan

[21] Appl. No.: 649,471

[22] Filed: May 17, 1996

Related U.S. Application Data

[62] Division of Ser. No. 474,721, Jun. 7, 1995, abandoned.

[30] Foreign Application Priority Data

Jul. 11, 1994 [JP] Japan ..... 6-180502

[51] Int. Cl.[6] ..... G03C 1/015; G03C 1/035; G03C 1/07

[52] U.S. Cl. ..... 430/567; 430/569

[58] Field of Search ..... 430/569, 567

[56] References Cited

U.S. PATENT DOCUMENTS

| | | | |
|---|---|---|---|
| 4,983,508 | 1/1991 | Ishiguro et al. | 430/569 |
| 5,275,930 | 1/1994 | Maskasky | 430/567 |
| 5,292,632 | 3/1994 | Maskasky | 430/567 |
| 5,356,764 | 10/1994 | Szajewski et al. | 430/567 |
| 5,432,052 | 7/1995 | Ohshima | 430/569 |
| 5,449,596 | 9/1995 | Kawai et al. | 430/567 |

FOREIGN PATENT DOCUMENTS

| | | | |
|---|---|---|---|
| 569971 | 11/1993 | European Pat. Off. . | |
| 5-313273 | 11/1993 | Japan | G03C 1/035 |

*Primary Examiner*—Mark F. Huff

*Attorney, Agent, or Firm*—Sughrue, Mion, Zinn, Macpeak & Seas

[57] ABSTRACT

A method for producing a silver halide emulsion comprising tabular silver halide grains having a silver chloride content of 80% or more, the tabular silver halide grains having {100} planes as the main planes and an aspect ratio of 1.5 or more accounting for 10% or more of the total projected area of the grains, with the main planes in the form of a right-angled parallelogram having defects in at least one corner thereof, and with the grains being produced in the presence of a grain growth modifier.

1 Claim, 1 Drawing Sheet

PREPARATION OF HIGH CHLORIDE CONTENT (100) TABULAR GRAINS HAVING CORNER DEFECTS

This is a Divisional of U.S. Ser. No. 08/474,721 filed Jun. 7, 1995 now abandoned.

FIELD OF THE INVENTION

The present invention relates to a silver halide emulsion having a high silver chloride content.

BACKGROUND OF THE INVENTION

Hitherto, many efforts have been made to suppress fogging of a silver halide photographic emulsion and to increase photographic sensitivity. At the same time, shortening of the development processing including development, bleaching and fixing gives a great merit in practice and is another target in improving performance of a silver salt photograph. Also, a great merit can be practically provided by minimizing the change in photographic properties due to scattering of processing conditions. A highly sensitive photographic material conventionally uses in practice a silver iodobromide emulsion subjected to gold/sulfur sensitization. However, it is known that the use of silver iodobromide emulsion leads to failure in shortening of the development time due to a conspicuous development inhibitory action by the iodide ion and bromide ion released at the development and is associated with an increase of scattering in photographic properties because the ions accumulate in the processing. The ions are also known to inhibit bleaching. At the same time, the silver iodobromide emulsion is low in the solubility in water and the fixing requires a long period of time. A silver chlorobromide emulsion having a high silver chloride content and substantially free of silver iodide is known as a preferred material because it shortens respective processes of, development, bleaching and fixing and minimizes change in photographic properties due to scattering of processing conditions. On the other hand, the silver chloride emulsion is known to have a defect in that the sensitivity is generally low and, accordingly, various techniques have been proposed for rendering the silver halide emulsion having a high silver chloride content highly sensitive to overcome this defect.

European Patent 0534395A1 discloses that high sensitivity can be achieved by the use of tabular grains having {100} planes as the main planes.

The {100} tabular grain having the main planes in the form of a right-angled parallelogram is described in JP-A-51-88017 (the term "JP-A" as used herein means an "unexamined published Japanese patent application") and JP-B-64-8323 (the term "JP-B" as used herein means an "examined Japanese patent publication"). However, either of these publications relates to a rectangular parallelopiped grain having main planes in the form of a right-angled quadrilateral with all outer surfaces being {100} planes. Also, JP-A-5-313273 describes a grain in which the main planes are in the form of a right-angled quadrilateral with four angles being asymmetrically in defect. As compared with a grain of which surfaces all are {100} planes, a grain having other crystal planes in combination is preferred because the grain surfaces can be separated in function. With respect to the functional separation of the grain surface, JP-A-2-34, JP-A-1-201651 and JP-A-2-298935 may be referred to.

However, the high silver chloride emulsion usually has {100} planes and a high silver chloride emulsion of grains having planes other than the {100} plane, for example, a {111} plane, requires the use of a special technique and not so many investigation examples are present thereon. *Journal of Photographic Science*, Vol. 21, p. 39 (1973) reports only that a silver chloride grain having a {111} plane can be produced by using dimethylurea but does not refer to photographic properties of the grain. In International Congress of Photographic Science, Rochester (1978), Wyrsh reported that a grain having a {111} plane can be prepared by using a cadmium compound and ammonia. Wyrsh reported that on comparison between a grain having a {111} plane and a grain having a {100} plane on the photographic sensitivity using a sulfur sensitized emulsion, the difference therebetween is not so great but the grain having a {100} plane shows a slightly higher ultimate sensitivity. JP-A-55-26589 discloses that a silver chloride grain having a {111} plane can be obtained by forming the grain in the presence of a merocyanine dye. However, the high silver chloride grain having a {111} plane disclosed in the above-described patent application is not intended as a highly sensitive photographic material and the disclosure is only to show that the restriction in the addition method of a dye is useful irrespective of the crystal plane or composition of the grain. Accordingly, although the high silver chloride emulsion is well known as a preferred material for shortening the processing, it has been considered difficult from a technical viewpoint to produce a high silver chloride photographic material having high sensitivity because conspicuous fogging is caused when chemical sensitization is sufficiently effected so as to achieve high sensitivity. Also, it is a matter of ordinary knowledge that gold sensitization is accompanied by the increase in fogging and thus, it is the status quo that no satisfactory technique has been reached for subjecting a high silver chloride emulsion to sufficient gold/chalcogen sensitizations which are considered essential in the case of a highly sensitive photographic material.

SUMMARY OF THE INVENTION

The object of the present invention can be achieved by:

(1) a silver halide emulsion comprising silver halide grains having a silver chloride content of 80 mole % or more, and being tabular grains having {100} planes as the main planes and an aspect ratio of 1.5 or more accounting for 10% or more of the total projected area of grains, with the main planes in the form of a right-angled parallelogram being defective in at least one corner thereof; and preferably (2) a silver halide emulsion as described in (1) above, which is produced by adding at least one kind of a grain growth modifier in an amount of from 50 to 90 mole % based on the silver amount used for the grain formation without causing any fluctuation in the excessive halogen concentration in the solution.

Accordingly, an object of the present invention is to provide a silver halide emulsion for use in a silver halide photographic material, which undergoes little fogging, provides high photographic sensitivity and can be subjected to rapid processing.

DETAILED DESCRIPTION OF THE INVENTION

Figure 1:
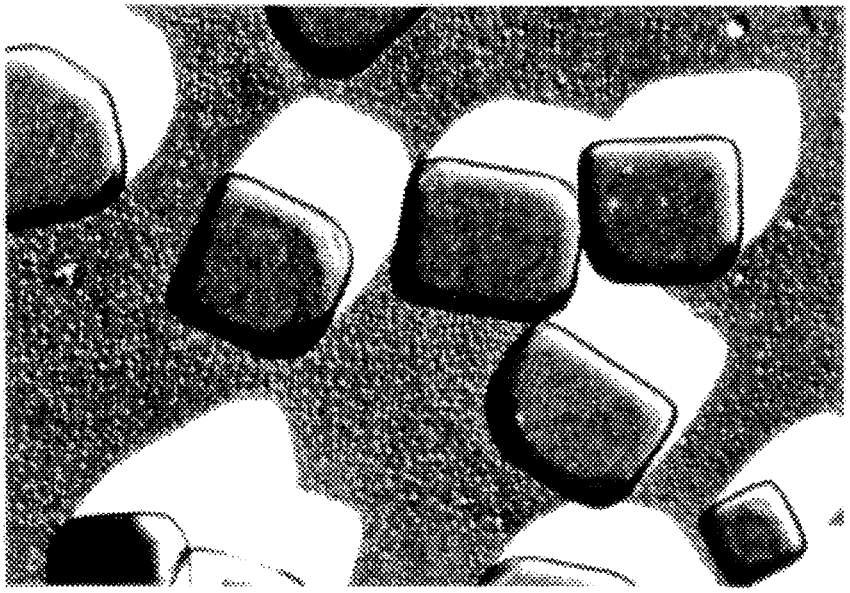
FIG. 1 shows an electron microscopic photograph of Emulsion C (magnification: ×16,000).

The present invention is described below in detail.

The tabular silver halide grain having {100} planes as the main planes has a silver chloride content of 80 mole % or more, preferably 90 mole % or more, most preferably 95 mole % or more.

The silver halide emulsion used in the present invention comprises at least a dispersion medium and the above-described silver halide grain, in which tabular silver halide grain having {100} planes as the main planes accounts for 10% or more, preferably from 35 to 100%, more preferably from 60 to 100% of the total projected area of silver halide grains in the emulsion. The term "projected area" as used herein means a projected area of a grain placed on a base plate in a state such that silver halide emulsion grains are not piled up and that the main planes lie in parallel with the base plate surface. The term "main planes" as used herein means two maximum outer surfaces paralleled with each other of one tabular grain. The tabular silver halide grain has an aspect ratio (diameter/thickness) of 1.5 or more, preferably 2 or more, more preferably from 3 to 25, most preferably from 3 to 7. The term "diameter" as used herein means a diameter of a circle having the area equal to the projected area of a grain on observing the grain through an electron microscope. The term "thickness" as used herein means a distance between main planes of a tabular grain. The tabular silver halide grain has a diameter of preferably 10 μm or less, more preferably from 0.2 to 5 μm, most preferably from 0.2 to 3 μm, and a thickness of preferably 0.7 μm or less, more preferably from 0.03 to 0.3 μm, most preferably from 0.05 to 0.2 μm. The tabular grain preferably has a monodisperse grain size distribution and has a coefficient of fluctuation of preferably 40% or less, more preferably 20% or less.

The tabular silver halide grain having {100} planes as the main planes and having a silver chloride content of 80 mole % or more may be prepared according to the methods described in European Patent 0534395A1, from page 7, line 53 to page 19, line 35 and JP-A-6-59360, paragraphs from 0006 to 0024 but the grain prepared by either method above has no discontinuous halogen composition gap face in the center portion and is of a uniform halogen composition type or of a gentle halogen composition change type. In this case, it is very difficult to selectively form tabular grains and the scattering in production may be caused. Also, the size distribution may be broadened to provide an improper image quality such as sensitivity, gradation or granularity.

In order to overcome these problems, the grain preferably has a discontinuous silver halide composition gap face in the center portion and the number of the silver halide composition gap face is one or more, preferably from 2 to 4, more preferably 2. The "center portion" as used herein is not necessarily the center itself of a grain but the neighborhood of the center may suffice therefor. However, the halogen composition gap face is preferably positioned nearer to the center because a tabular grain having a higher aspect ratio can be formed.

1) Specific Examples of the Grain Having One Halogen Composition Gap Face

Specific examples of this type grain include a grain resulting from laminating AgBr on the AgCl nucleus (AgCl/AgBr), a grain resulting from laminating AgBrI on the AgCl nucleus (AgCl/AgBrI) and a grain resulting from laminating AgBr on the AgClBr nucleus (AgClBr/AgBr) and the grain of this type is more generally shown by ($AgX^1/AgX^2$) where $X^1$ and $X^2$ differ in terms of a $Cl^-$ content or $Br^-$ content by from 10 to 100 mole %, preferably from 30 to 100 mole %, more preferably from 50 to 100 mole %, most preferably from 70 to 100 mole %.

2) Specific Examples of the Grain Having Two Halogen Composition Gap Faces

As expressed in the same manner as above, specific examples of this type grain include (AgBr/AgCl/AgBr), AgCl/AgBr/AgCl), (AgBrI/AgCl/AgBrI) and AgCl/AgClBr/AgCl) and the grain is more generally shown by ($AgX^1/AgX^2/AgX^3$)where $X^1$ and $X^3$ may be the same or different and the halogen composition gap between adjacent layers follows the above-described rules.

The halogen composition gap face has a discontinuous difference in the halogen composition and more specifically, it means that the halogen composition of a halogen salt solution (hereinafter referred to as an $X^-$ salt solution) added or the halogen composition of a silver halide fine grain added is varied discontinuously at the gap face according to the above-described rules but does not mean the grain structure itself. The halogen composition gap is particularly preferably a gap where the $Br^-$ content but not $I^-$ content is varied and two gaps are preferably present where $Br^-$ content is differentiated.

The silver halide grain first formed has a circle-corresponding projected grain size of preferably 0.15 μm or less, more preferably from 0.02 to 0.1 μm, most preferably from 0.02 to 0.06 μm.

The $AgX^2$ layer has a thickness sufficiently large to give preferably the amount to cover one lattice layer on average on the surface of the $AgX^1$ layer, more preferably from the amount to cover three lattice layers to 10 molar times the amount of the $AgX^1$ layer, still more preferably from the amount to cover 10 lattice layers to 3 molar times the amount of the $AgX^1$ layer. The gap structure is preferably uniform among grains so that grains uniform in the (screw dislocation number/grain) which will be described later can be formed and tabular grains having a narrow grain size distribution can be formed.

FIG. 1 shows an example of the shape of main planes of a tabular AgX grain of the present invention and as shown in FIG. 1, the main planes are in the form of a right-angled parallelogram with at least one corner being defective.

Figure 2:
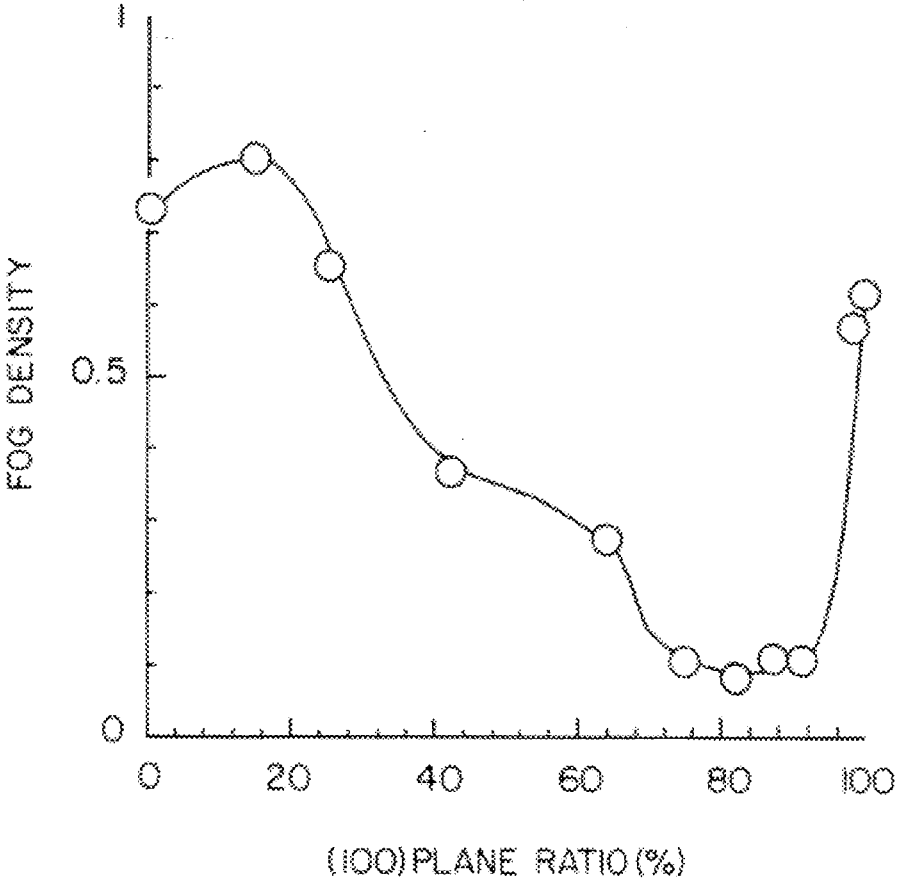
FIG. 2 shows the relation between the {100} plane ratio for reference and the fogging.

FIG. 2 shows fogging generated when a silver chloride grain is subjected to sulfur sensitization by accompanying the change in the {100} plane ratio, namely, change from the {111} plane to {100} plane.

As is clearly seen from FIG. 2, a peculiar range undergoing little fogging is present when the emulsion grain has a {100} plane ratio of from 75 to 95%. It is also seen from FIG. 2 that a fogged nucleus is apt to be formed at the corner part of the grain in the case of a cubic grain consisting only of {100} planes and at the edge line part where the {111} plane is in contact with the {111} plane in the case of a grain having a small {100} plane ratio. This is confirmed by stopping the development before the development proceeds so much and directly observing by means of an electron microscope the position where a fogged nucleus is formed. The grain of the present invention is defective in the corner part, where three {100} planes intersect, equal to the corner part of a cubic grain where a fogged nucleus is readily formed, and is effective in inhibiting fogging. It can be entirely unexpected matter from the conventional techniques that the increase in fog density can be inhibited by eliminating the corner part having an intersection of three {100} planes.

Preparation of the tabular silver halide emulsion of the present invention:

The tabular silver halide emulsion of the present invention is produced through at least nucleation→ripening.

The nucleation is first described below.

(1) Nucleation

An $AgNO_3$ solution and a halide salt (hereinafter referred to as $X^-$) solution are added to a dispersion medium solution containing at least a dispersion medium and water while stirring to form nuclei.

At this nucleation time, a defect giving rise to anisotropic growth is formed. The defect formed is called a screw dislocation. In order to form the screw dislocation, the nucleation atmosphere must be a {100} plane atmosphere so that the {100} crystal plane can appear on nuclei. In the case of an AgCl nucleus, unless specific adsorbents and specific conditions are used, {100} crystal planes appear under normal conditions. Accordingly, the screw dislocation may be formed under normal conditions. The specific adsorbents and specific conditions as used herein mean the conditions for forming twin planes or the conditions for forming octahedral AgCl grains and in this point, U.S. Pat. Nos. 4,399,215, 4,414,306, 4,400,463, 4,713,323, 4,804,621, 4,783,398, 4,952,491 and 4,983,508, *Journal of Imaging Science*, Vol. 33, p. 13 (1989), ibid., Vol. 34, p. 44 (1990), and *Journal of Photographic Science*., Vol. 36, p. 182 (1988) may be referred to.

On the other hand, in the case of an AgBr nuclei, {100} planes are formed only under limited conditions, in other words, the conditions conventionally known for forming cubic or tetradecahedral AgBr grains. The screw dislocation may be formed under these conditions. In this case, the tetradecahedron preferably has the ratio $x^1$ (={111} plane area/{100} plane area} of from 0 to 1, more preferably from 0 to 0.3, most preferably from 0 to 0.1. In the case of AgBrCl grain, the characteristics can be considered to change proportionally to the $Br^-$ content. Accordingly, as the $Br^-$ content increases, the conditions for nucleation come under narrower limitation. The above-described area ratio can be determined by a measuring method using the plane selection absorbance dependency of a {111} plane and a {100} plane of a sensitizing dye (see, T. Tani, *Journal of Imaging Science*, Vol. 29, p. 165 (1985)).

In addition, the {100} plane formation may be accelerated by putting a {100} plane formation accelerator present together at the nucleation. Specific examples of the accelerator and the use method thereof are described in European Patent 0534396A1. In brief, an adsorbent containing an N atom having a pair of resonance stabilized $\pi$ electrons is laid present together in a dispersion medium solution in an amount of from $10^{-5}$ to 1 mole/liter, preferably from $10^{-4}$ to $10^{-1}$ mole/liter and the pH is set higher than the (pKa value −0.5) of the compound, preferably higher than the pKa value, more preferably higher than the (pKa value +0.5).

The dispersion medium solution at the nucleation has a dispersion medium concentration of from 0.1 to 10 wt %, preferably from 0.2 to 5 wt %, a pH of from 1 to 12, preferably from 2 to 11, more preferably from 5 to 10, and a $Br^-$ concentration of $10^{-2}$ mole/liter or less, preferably $10^{-2.5}$ mole/liter or less. The temperature is preferably 90° C. or lower, more preferably from 15° to 80° C. and the $Cl^-$ concentration is more preferably $10^{-1}$ mole/liter or less.

The nucleus is formed in a nucleus {100} plane forming atmosphere to introduce the screw dislocation into the nucleus and in the present invention, the screw dislocation is introduced into the nucleus by forming one or more, preferably from two to four, more preferably two halogen composition gap faces in the nucleus. This is to forcedly introduce a screw dislocation into a nucleus by using the misfit in the lattice constant between adjacent layers, generated on the nucleus gap face, and this is superior in the production reproducibility to the method described in European Patent 0534395A1. More specifically, European Patent 0534395A1 discloses a method for mixing $I^-$ having an extremely large ion radius into the AgCl lattice or a method using coagulation of nuclei, which are, however, bad in the production reproducibility. Also, the mixing of $I^-$ into AgCl causes reduction in the processing ability of the developer and is not preferred in particular. Further, since the screw dislocation is scarcely introduced in the case of a uniform composition such as ClBr and AgBrI, the system which can be selected is disadvantageously limited.

More specifically, in forming nuclei by adding a silver salt solution and an $X^-$ salt solution by a double jet addition method, the halogen composition in the $X^-$ salt solution is discontinuously changed during the nucleation. For example, the nucleation term is divided into two sections and the $X^-$ salt solution added in the first nucleation term and the $X^-$ salt solution added in the next nucleation term are discontinuously changed in their halogen composition according to the above-described gap amount in the halogen composition. Or, the nucleation term is divided into three sections and the halogen composition of $X^-$ salt solutions added first, second and third are changed in the halogen composition according to the above-described gap amount. Further, the nucleation term is divided into n sections (n is an integer of 1 or more) and the halogen composition of the $X^-$ salt solution between adjacent nucleation addition terms is discontinuously changed in the halogen composition according to the above-described gap amount. The a=(number of screw dislocations formed/grain) depends on the gap difference of the halogen composition, the thickness of each of $AgX^1$, $AgX^2$ and $AgX^3$ layers and the pH, pAg, temperature, dispersion medium concentration and adsorbent concentration during the nucleation.

The nucleus may be formed under the conditions such that bar grain nuclei or twin grain nuclei each having one screw dislocation or nuclei having a growth acceleration defect in the three-dimensional direction are grown at a low frequency and tabular grain nuclei are grown at a high frequency. Depending upon the case, the nucleus may be formed under the most preferred conditions as a design of experiment in a try-and-error method. In order to prevent the generation of twin grains, the above-described adsorbent selectively adsorbing onto the {100} plane is preferably used in combination.

A dispersion medium may be incorporated into the silver salt solution and/or $X^-$ salt solution added to enable uniform nucleation at the nucleation time. The concentration of the dispersion medium in these solutions is preferably 0.1 wt % or more, more preferably from 0.1 to 2 wt %, most preferably from 0.2 to 1 wt %. The dispersion medium is more preferably a low molecular gelatin having a molecular weight of from 3,000 to 50,000.

On the other hand, the concentration of the dispersion medium added to a reaction vessel is preferably 0.1 wt % or more, more preferably from 0.2 to 5 wt %, most preferably from 0.3 to 2 wt %. The solution in the reaction vessel has a pH of from 1 to 12, preferably from 3 to 10, more preferably from 5 to 10.

(2) Ripening

It is impossible to selectively form only the tabular grain nuclei during nucleation. Accordingly, grains other than the tabular grains are caused to vanish by Ostwald ripening during the next ripening step. The ripening temperature is preferably set higher than the nucleation temperature, preferably by 10° C. or more, more preferably 20° C. or more. It is usually from 50° to 90° C., preferably from 60° to 80° C. When the ripening temperature exceeds 90° C., the ripening is preferably conducted under a pressure higher, preferably 1.2 times or more higher, than the atmospheric pressure. On the detail of the ripening under pressure, JP-A-5-173267 may be referred to. The ripening is preferably conducted in a {100} plane forming atmosphere, more specifically, under the above-described conditions for forming cubes or tetradecahedrons.

In the case where the $Br^-$ content of the nucleus is 70 mole % or more, more preferably 90 mole % or more, the excessive ion concentration of $Ag^+$ and $Br^-$ in the solution at ripening each is preferably $10^{-2.3}$ mole/liter or less, more preferably $10^{-2.6}$ mole/liter or less. The pH of the solution is preferably 2 or more, more preferably from 2 to 11, most preferably from 2 to 7. When the ripening is conducted at a pH and a pAg in the above-described range, cubic fine grains having no defect mainly vanish and tabular grains preferentially grow in the edge direction. As it departs from the above-described conditions for the excessive ion concentration, the preferential growth in the edge is reduced and the vanishing rate of non-tabular grains is retarded. Also, the growth rate of grains on the main planes increases and the aspect ratio of the grain is lowered. At the time of ripening, if an AgX solvent is present together, the ripening is accelerated. However, this condition changes according to the halogen composition of the Agx grain, the pH, the pAg, the gelatin concentration, the temperature and the AgX solvent concentration and therefore, the optimal conditions may be selected in a try-and-error method depending upon respective cases.

In the case where the $C^-$ content of the nucleus is preferably 30 mole % or more, more preferably 60 mole % or more, most preferably 80 mole % or more, the $C^-$ excessive ion concentration in the solution at the ripening is in terms of pCl value 3 or less, more preferably from 1 to 2.5, most preferably 1 to 2. The pH is preferably from 2 to 11 and more preferably from 3 to 9.

In addition, the ripening can be conducted while adding a silver salt solution and an $X^-$ salt solution by a double jet process under a low supersaturation condition. At a low supersaturation degree, the growth activating point having a screw dislocation preferentially grow and fine grains free of the defect vanish. This is because although the supersaturation degree necessary for forming on the growth activating point metastable nuclei for the growth is low, the supersaturation degree necessary for forming the metastable nuclei on the defect-free plane is high. The low super-saturation as used herein means preferably 30% or less, more preferably 20% or less of the critical addition time. The critical addition time as used herein means the saturation degree at the time when the silver salt solution and the $X^-$ salt solution are added at such a speed that new nuclei are generated if the solutions are added at a speed higher than that.

At the end of ripening, the solution may be used as the emulsion of the present invention, however, since the growth amount (mole/liter) of AgX grains is small and the grain size cannot be freely selected, a crystal growth step which will be described later is usually provided.

In the ripening, a grain growth modifier such as a compound represented by the following formula (I) or (II) (see, JP-A-2-32), an imidazole derivative described in JP-A-55-42737, adenine or sodium poly-co-acrylic-co-2-methacryloyloxyethyl-2-sulfonate described in U.S. Pat. No. 4,400,463, an adenine analogue described in U.S. Pat. No. 4,801,523 or a thiourea derivative described in JP-A-62-218959, JP-A-63-213836 and JP-A-63-218938 is used and the grain is formed in the presence of at least one of these compounds. In particular, the grain is preferably formed in the presence of at least one of the Compounds (i.e., grain growth modifier) represented by the following formulae (I) and (II) (JP-A-2-32):

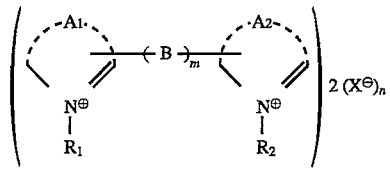

(I)

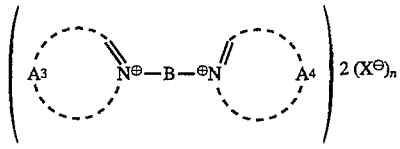

(II)

wherein $A_1$, $A_2$, $A_3$ and $A_4$, which may be the same or different, each represents a nonmetallic atom group necessary for accomplishing a nitrogen-containing hetero ring, B represents a divalent linking group, m represents 0 or 1, $R_1$ and $R_2$ each represents an alkyl group, X represents an anion, n represents 0 or 1 and when an intramolecular salt is formed, n is 0.

The formulae (I) and (II) will be described below in greater detail.

$A_1$, $A_2$, $A_3$ and $A_4$ each represents a nonmetallic atom group necessary for accomplishing a nitrogen-containing hetero ring and may contain an oxygen atom, a nitrogen atom or a sulfur atom. The benzene ring may be condensed. The hetero ring constituted by $A_1$, $A_2$, $A_3$ or $A_4$ may have a substituent and the substituent may be the same or different. Examples of the substituent include an alkyl group, an aryl group, an aralkyl group, an alkenyl group, a halogen atom, an acyl group, an alkoxycarbonyl group, an aryloxycarbonyl group, a sulfo group, a carboxyl group, a hydroxy group, an alkoxy group, an aryloxy group, an amido group, a sulfamoyl group, a carbamoyl group, a ureido group, an amino group, a sulfonyl group, an acyl group, a nitro group, a mercapto group, an alkylthio group and an arylthio group. In a preferred embodiment, $A_1$, $A_2$, $A_3$ and $A_4$ each forms a 5- or 6-membered ring such as a pyridine ring, an imidazole ring, a thiazole ring, an oxazole ring, a pyrazine ring or a pyrimidine ring, more preferably a pyridine ring.

B represents a divalent linking group and the divalent linking group is constituted by alkylene, arylene, alkenylene, —$SO_2$—, —SO—, —O—, —S—, —C(O)— or —N($R_3$)— (wherein $R_3$ represents an alkyl group, an aryl group or a hydrogen atom) individually or in combination. Preferably, B is an alkylene or alkenylene.

$R_1$ and $R_2$ may be the same or different and each represents an alkyl group having from 1 to 20 carbon atoms.

The alkyl group includes substituted and unsubstituted alkyl groups and examples of the substituent include those described as the substituent for $A_1$, $A_2$, $A_3$ and $A_4$.

$R_1$ and $R_2$ each preferably represents an alkyl group having from 4 to 10 carbon atoms and more preferably a substituted or unsubstituted aryl-substituted alkyl group.

X represents an anion and examples thereof include chloride ion, bromide ion, iodide ion, nitrate ion, sulfate ion, p-toluenesulfonate or oxalate.

n represents 0 or 1 and in the case of an intramolecular salt, n is 0.

Specific examples of the compound represented by formula (I) or (II) are illustrated below, but the present invention is by no means limited to these compounds.

(1)
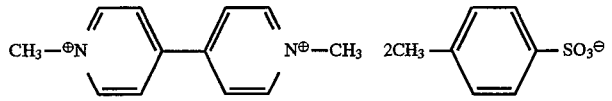
(2)
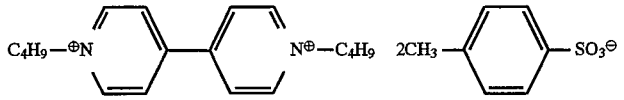
(3)
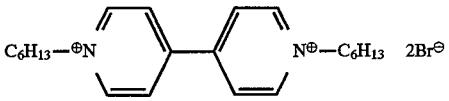
(4)
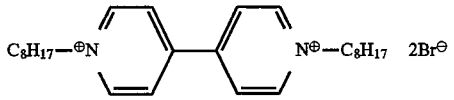
(5)
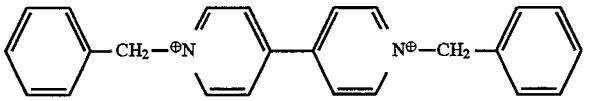
(6)
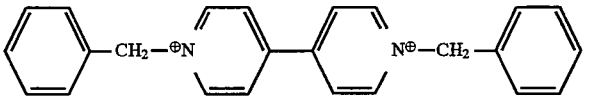
(7)
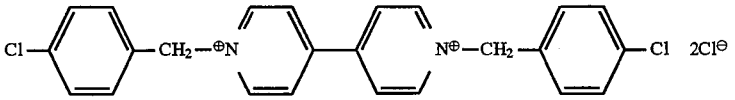
(8)
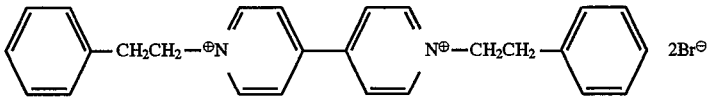
(9)
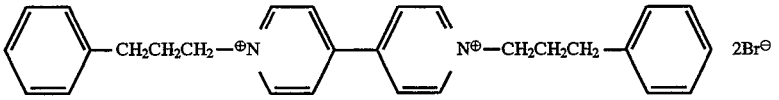
(10)
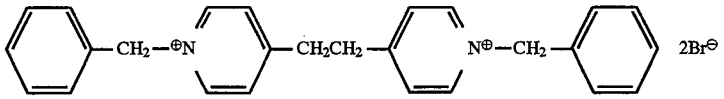
(11)
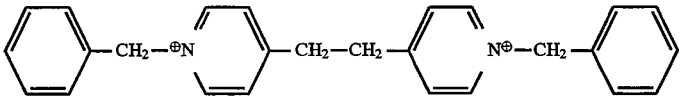
(12)
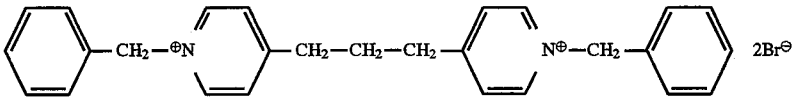
(13)
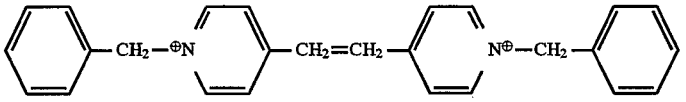
(14)
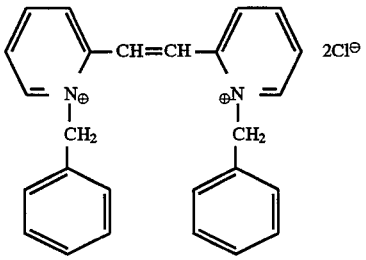
(15)
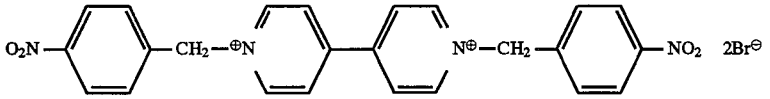

-continued
(16)
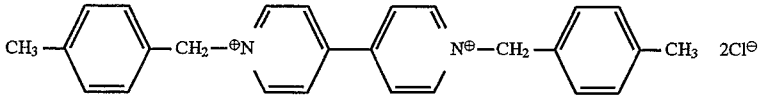
(17)
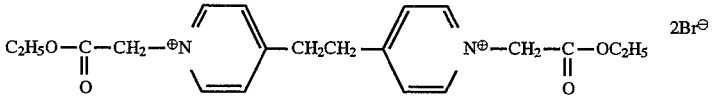
(18)
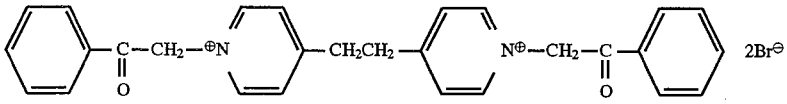
(19)
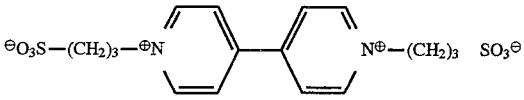
(20)
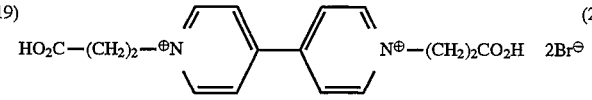
(21)
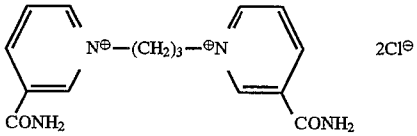
(22)
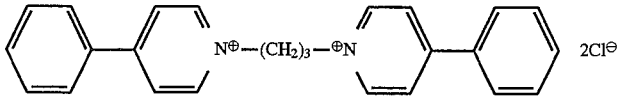
(23)
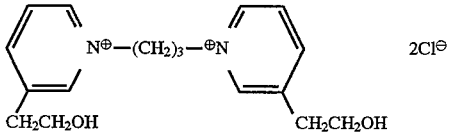
(24)
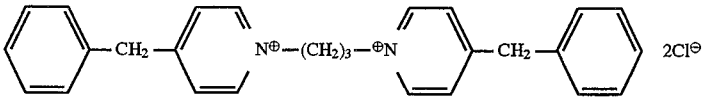
(25)
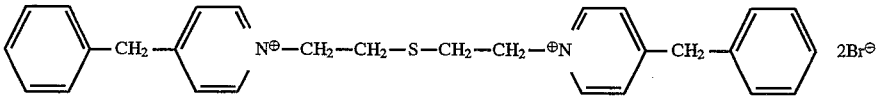
(26)
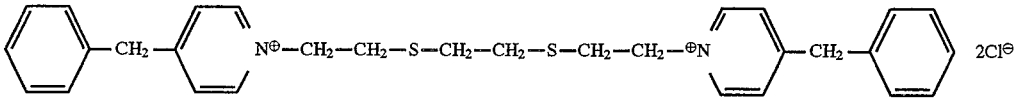
(27)
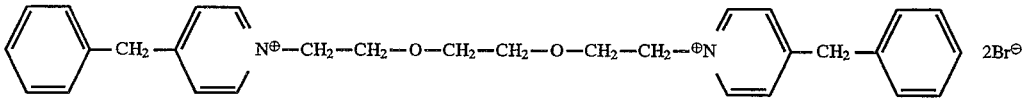
(28)
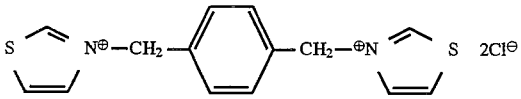
(29)
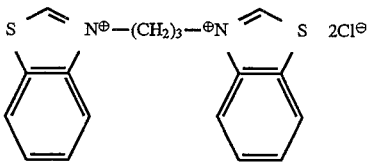
(30)
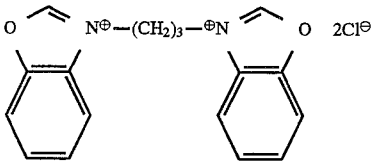
(31)
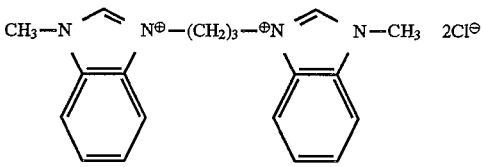

-continued (32)

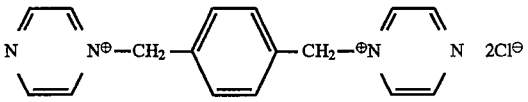

(33)

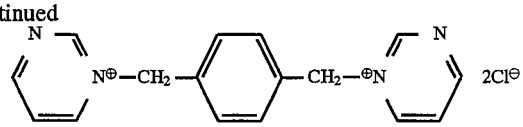

(34)

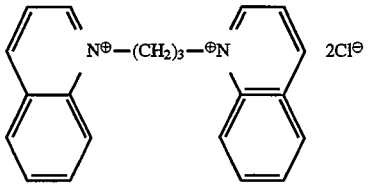

(35)

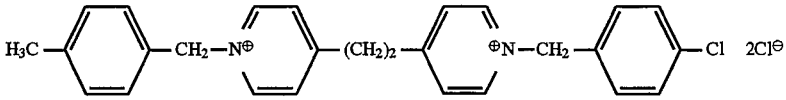

(36)

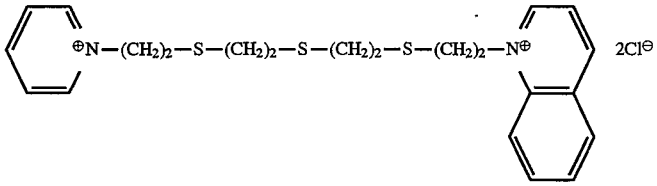

(37)

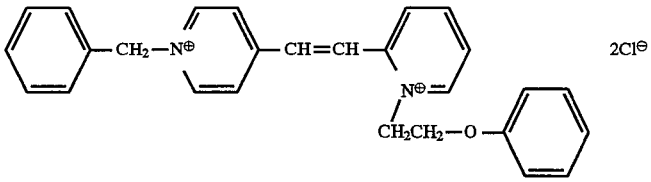

(38)

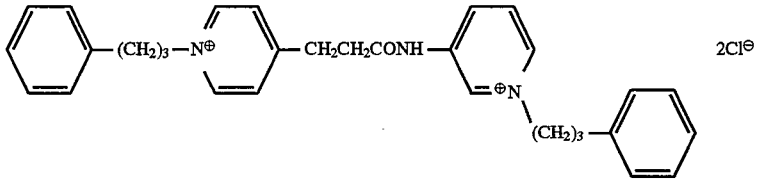

(40)

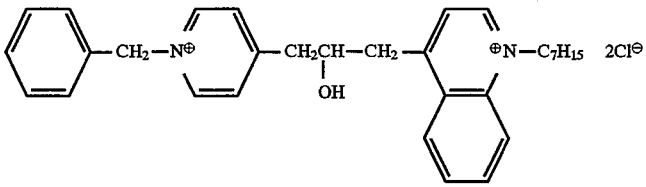

The compound represented by formula (I) or (II) is added in an amount of from $2\times10^{-5}$ to $3\times10^{-1}$ mole, more preferably from $2\times10^{-4}$ to $1\times10^{-1}$ mole, per mole of the silver halide.

The addition time of the above-described compound may be any during the grain formation in the production of a silver halide emulsion from the nucleation of silver halide grains to the completion of physical ripening.

In the case when the above-described compound is present at the grain growth, the chloride concentration is 5 mole/liter or less, preferably 0.5 mole/liter.

The temperature at the grain formation in the present invention is from 10° to 95° C., more preferably from 40° to 90° C.

The pH may be any but preferably is in the range of from neutral to acidic.

(3) Crystal Growth Step

In the ripening step, the tabular grain proportion is increased and the grain is grown to a desired size. The grain is grown under the condition for forming {100} planes as defined above. In this case, 1) an ion solution addition method where the grain is grown by adding a silver salt solution and an $X^-$ salt solution, 2) a fine grain addition method where AgX fine grains are previously formed and the fine grains are added and grown or 3) a combination method of these two methods may be used in combination.

In order to preferentially grow the tabular grain in the edge direction, the grain may be grown under a low supersaturation condition. The low supersaturation condition here is preferably 35% or less, more preferably from 2 to 20% of the critical addition time.

Conventionally, the lower the supersaturation degree, the broader the grain size distribution. This is because at a low supersaturation degree, the solute ions collide against the grain surface at a low frequency and as a result, the nuclei to grow are formed at a low frequency, thus this growing nucleus formation step becomes a rate-determining step. The probability of the growing nucleus formation is proportional to the area in the uniform solution condition and therefore, grains having a large growth plane area grow at a higher speed. Accordingly, large grains grow faster than small grains and as a result, the grain size distribution becomes broader. This growth behavior is observed in regular crystal grains having no twin plane or in tabular grains having parallel twin planes. More specifically, the linear growth rate is proportional to the surface area in the case of a regular crystal grain and to the peripheral length of the edge (namely, the length of trough line) in the case of a parallel twin tabular grain.

On the other hand, in the grain of the present invention, among edge planes of the grain, only the screw dislocation defective part (d1) serves as a growth starting point and therefore, the frequency of formation of growing nuclei is proportional to the number of d1. Accordingly, when the (number of d1/grain) is made even, grains uniformly grow even at a low supersaturation degree and as the average grain size increases, the coefficient of fluctuation becomes small. By making even the size of nuclei formed at the nucleation and also making even the characteristics of the halogen composition gap face among grains, the (number of d1/grain) can be made even. In order to form nuclei having an even size, the generation of new nuclei is completed within a short period of time and then the nuclei generated are grown to have an even size at a high supersaturation concentration without generating new nuclei. When this is conducted at a low temperature, small nuclei having an even size can be formed. The low temperature here means the temperature of 50° C. or lower, preferably from 5° to 40° C., more preferably from 5° to 30° C. The short period of time here means the time period of 3 minutes or shorter, more preferably 1 minute or shorter, still more preferably from 1 to 20 seconds.

When the tabular grain is grown at the above-described low supersaturation condition, the solute ions adsorbed to the main planes desorb before the conversion of 2→n polymers takes place, to constitute an adsorption/desorption equilibrium and are finally taken into the edge portion. This is understood by considering the chemical equilibrium among on the main planes, in the solution phase and on the edge planes according to an energy diagram, applying van't Hoff equation of reaction isobar [$dLnKp/dT=\Delta H^0/RT^2$] obtained from the Gibbs-Helmholtz equation and the chemical equilibrium ($\Delta G^0=-RTLnKp$) and plotting data of the change in temperatures for the grown length of the main planes and edge planes. In usual, the desorption of solute ions adsorbed to the main planes is accelerated at higher temperatures and the edge planes are more selectively grown. Assume that Kp=(grown length of edge plane/grown length of main plane), then $\Delta H$ is about 13 KCal/mole.

When the saturation degree is high at the time of crystal growth, growing nuclei are formed also on defect-free planes at a high frequency, in other words, tabular grains are grown also in the thickness direction and as a result, the resulting tabular grains are forced to have a low aspect ratio. This reveals that the growth proceeds in a polynuclear growth mode. If the saturation degree is further elevated, the growing nuclei are formed at a higher frequency and the growth continuously changes into the diffusion rate-determining growth.

In the fine grain emulsion addition method, an AgX fine grain emulsion having a size of 0.15 μm or less, preferably 0.1 μm or less, more preferably from 0.06 to 0.006 μm is added and the tabular grains are grown by Ostwald ripening. The fine grain emulsion may be added continuously or intermittently. The fine grain emulsion is continuously prepared in a mixer provided in the vicinity of the reaction vessel by supplying an $AgNO_3$ solution and an $X^-$ salt solution into the mixer and then continuously added to the reaction vessel, or it may be prepared in a batch system in a separate vessel and then continuously or intermittently added. The fine grain emulsion may be added as a solution or as a dry powder. It is preferred that the fine grain contains substantially no multiple twin grain. The multiple twin grain as used herein means grains having two or more pairs of twin planes per one grain. The term "contain substantially no" as used herein means that the multiple twin grain number ratio is 5% or less, preferably 1% or less, more preferably 0.1% or less. More preferably, the grain contains substantially no single twin grain. Most preferably, it contains substantially no screw dislocation. The term "contain substantially no" as used herein is the same as defined above.

By adding a grain growth modifier described above during these crystal growth steps, the AgX grain of the present invention can be obtained. The grain can be obtained by adjusting the excessive halogen concentration without controlling the silver potential in the solution, thus the grain can be produced in an apparatus where the silver potential cannot be controlled.

The grain modifier is preferably added in an amount of from 50 to 90 mole % of the silver amount used for the grain formation.

The halogen composition of the emulsion may be the same or different among grains, but when an emulsion having the same halogen composition among grains is used, it is easy to unify the properties of respective grains. The tabular grain of the present invention can be made to have a halogen composition distribution during the growth of tabular grains, separately from the halogen composition gap for forming tabular nuclei. Examples thereof include a grain having a so-called laminate-type structure where the halogen composition is different between the core inside the silver halide grain and the shell (single layer or a plurality of layers) surrounding the core and a grain having a structure such that non-layered portions different in the halogen composition are provided inside the grain or on the grain surface (when provided on the grain surface, the portions different in the composition are conjugated at edges or corners or on planes), and these are appropriately selected on use. For achieving high sensitivity, these grains are advantageously used and they are also preferred in view of pressure stability. When the silver halide grain has the above-described structures, the boundary between portions different in the halogen composition may be clear, may be unclear resulting from formation of mixed crystals due to difference in the composition or may have sequential structural change provided positively.

The high silver chloride emulsion of the present invention preferably has a structure such that a silver bromide localized phase in the layer or non-layer form as described above is present in the inside and/or on the surface of a silver halide grain, separately from the halogen composition gap for forming tabular nuclei. The halogen composition of the above-described localized phase has a silver bromide content preferably of at least 10 mole %, more preferably exceeding 20 mole %. The localized phase can be present at edges or corners or on planes inside the grain or on the grain surface and one preferred example is a localized phase epitaxially grown at a corner of a grain.

For the purpose of obtaining a wide latitude, it is also preferred to blend monodisperse emulsions as described above in the same layer or coat the monodisperse emulsions in a superposed fashion.

All of the silver halide emulsions used in the present invention are usually subjected to chemical sensitization and spectral sensitization.

The chemical sensitization may be performed by effecting chemical sensitization using a chalcogen such as sulfur sensitization, selenium sensitization and tellurium sensitization, noble metal sensitization represented by gold sensitization, or reduction sensitization, individually or in combination. Preferred examples of the compound for use in the chemical sensitization include those described in JP-A-62-215272, from page 18, right lower column to page 22, right upper column.

The spectral sensitization is effected so as to impart spectral sensitivity at a desired light wavelength region to the emulsion of each layer of a photographic material of the present invention. In the present invention, it is preferably conducted by adding a dye which absorbs light in a wavelength region corresponding to the desired spectral sensitivity, a spectral sensitizing dye. Examples of the spectral sensitizing dye used here include those described in F. M. Harmer, *Heterocyclic Compounds-Cyanine Dyes and Related Compounds*, John Wiley & Sons, New York, London (1964). Specific and preferred examples of the compound and the spectral sensitization method include those described in JP-A-62-215272, from page 22, right upper column to page 38.

The silver halide emulsion for use in the present invention may contain various compounds or precursors thereof for the purpose of preventing fog during preparation, storage or photographic processing of a photographic material, or of stabilizing the photographic performance. Specific and preferred examples of these compounds include those described in JP-A-62-215272, pp. 39–72.

The emulsion used in the present invention is a so-called surface latent image-type emulsion where a latent image is mainly formed on the grain surface.

The photographic material of the present invention preferably contains in a hydrophilic colloidal layer a dye (e.g., an oxonol dye or a cyanine dye) capable of decolorization by the processing described in EP 0337490A2, pp. 27–76, so as to prevent irradiation or halation or to improve safety to the safelight. Also, a dye which is contained in a hydrophilic colloid layer as a solid particle dispersion and decolorized by the development, such as dyes described in JP-A-2-282244, from page 3, right upper column to page 8, or dyes described in JP-A-3-7931, from page 3, right upper column to page 11, left lower column, is preferably used. In using such a dye, dyes able to show absorption overlapping with the maximum spectral sensitivity peak of a light-sensitive layer having the longest wavelength are preferably selected and used. It is preferred for achieving increased sharpness to use such a dye to thereby give an optical density (a logarithm of a reciprocal of transmitted light) (reflection density in the case of a reflection support) of the photographic material at 680 nm or at a wavelength of a laser used for exposure, of 0.5 or more.

The photographic material of the present invention preferably contains non-diffusible cyan, magenta and yellow couplers.

The high boiling point organic solvent for photographic additives such as cyan, magenta and yellow couplers, which can be used in the present invention may be any compound as long as it has a melting point of 100° C. or lower and a boiling point of 140° C. or higher, is immiscible with water and serves as a good solvent for couplers. The melting point of the high boiling point organic solvent preferably 80° C. or lower and the boiling point thereof is preferably 160° C. or higher, more preferably 170° C. or higher.

The high boiling point organic solvent is described in detail in JP-A-62-215272, from page 137, right lower column to page 144, right upper column.

Also, the cyan, magenta or yellow coupler may be impregnated into a loadable latex polymer (described, for example, in U.S. Pat. No. 4,203,716) in the presence or absence of the above-described high boiling organic solvent and dissolved together with the insoluble and organic solvent-soluble polymer to be emulsion-dispersed into an aqueous hydrophilic colloid solution Preferred in view of dye image stabilization are homopolymers and copolymers described in U.S. Pat. No. 4,857,449 and International Pat. No. WO88/00723, pp. 12–30, more preferred are methacarylic or acrylamide-base polymers, and most preferred are acrylamide-base polymers.

The photographic material of the present invention preferably use a dye image preservability-improving compound as described in European Patent EP 0277589A2 in combination with couplers. In particular, a pyrazoloazole coupler or a pyrrolotriazole coupler is preferably used in combination.

In other words, it is preferred to use individually or simultaneously a compound which produces a chemically inert and substantially colorless compound by making chemical bonding to an aromatic amine developing agent remaining after color development and/or a compound which produces a chemically inert and substantially colorless compound by making chemical bonding to an oxidation product of an aromatic amine color developing agent remaining after color development, for preventing generation of stains or other side effects resulting from formation of a colored dye upon the reaction of a coupler with a color developing agent or an oxidation product thereof remaining in the layer during storage after processing.

Also, the photographic material of the present invention preferably contains an antimold as described in JP-A-63-271247 so as to prevent generation of various molds and bacteria which proliferate in hydrophilic colloid layers and deteriorate an image.

The support for use in the photographic material of the present invention may be, for the purpose of display, a white polyester-base support or a support having provided on the side carrying a silver halide emulsion layer a layer containing a white pigment. For achieving further improved sharpness, an antihalation layer is preferably provided on the silver halide emulsion layer-coated Side or on the back side of the support. In particular, the transmission density of the support is preferably set to fall within the range of from 0.35 to 0.8 so that the display can be enjoyed either by a reflected light or a transmitted light.

The photographic material of the present invention may be exposed to a visible light or an infrared light. The exposure may be a low-illumination exposure or a high-illumination short-time exposure and in the latter case, a laser scanning exposure system where the exposure time is $10^{-4}$ second or shorter per one picture element is particularly preferred.

At the time of exposure, a band stop filter described in U.S. Pat. No. 4,880,726 is preferably used. By using the filter, the light color mixing is eliminated and the color reproducibility is remarkably improved.

For the purpose of rapid processing, the exposed photographic material is preferably subjected to a bleach-fixing processing after color development. In particular, when the above-described high silver chloride emulsion is used, the pH of the bleach-fixing solution is preferably about 6.5 or less, more preferably about 6 or less so as to accelerate desilvering.

With respect to the silver halide emulsion, other materials (such as additives) and photographic constituent layers (for example, layer arrangement) for the photographic material of the present invention and the processing method for processing the photographic material and additives for the processing, those described in the following patents, particularly in EP 0355660A2 (corresponding to JP-A-2-139544), are preferably used.

| Photographic Constituent | JP-A-62-215272 | JP-A-2-33144 | EP 0355622A2 |
|---|---|---|---|
| Silver halide emulsion | p. 10, right upper col., line 6 to p. 12, left lower col., line 5 and p. 12, right lower col., line 4 from the bottom to p. 13, left upper col., line 17 | p. 28, right upper col., line 16 to p. 29, right lower col., line 11 and p. 30, lines 2 to 5 | p. 45, line 53 to p. 47, line 3 and p. 47, lines 20 to 22 |
| Silver halide solvent | p. 12, left lower col., lines 6 to 14 and p. 13, left upper col., line 3 from the bottom to p. 18, left lower col., last line | — | — |
| Chemical sensitizer | p. 12, left lower col., line 3 from the bottom to right lower col., line 5 from the bottom, p. 18, right lower col., line 1 to p. 22, right upper col., line 9 from the bottom | p. 29, right lower col., line 12 to last line | p. 47, lines 4 to 9 |
| Spectral sensitizer (spectral sensitization) | p. 22, right upper col., line 8 from the bottom to p. 38, last line | p. 30, left upper col., lines 1 to 13 | p. 47, lines 10 to 15 |
| Emulsion stabilizer | p. 39, left upper col., line 1 to p. 72, right upper col., last line | p. 30, left upper col., line 14 to right upper col., line 1 | p. 47, lines 16–19 |
| Development accelerator | p. 72, left lower col., line 1 to p. 91, right upper col., line 3 | — | — |
| Color coupler (cyan, magenta, yellow couplers) | p. 91, right upper col., line 4 to p. 121, left upper col., line 6 | p. 3, right upper col., line 14 to p. 18, left upper col., last line and p. 30, right upper col., line 6 to p. 35, right lower col., line 11 | p. 4, lines 15 to 27, p. 5, line 30 to p. 28, last line, p. 45, lines 29–31 and p. 47, line 23 to p. 63, line 50 |
| Coloration increasing agent | p. 121, left upper col., line 7 to p. 125, right upper col., line 1 | — | — |
| Ultraviolet absorbent | p. 125, right upper col., line 2 to p. 127, left lower col., last line | p. 37, right lower col., line 14 to p. 38, left upper col., line 11 | p. 65, lines 22 to 31 |
| Discoloration inhibitor (image stabilizer) | p. 127, right lower col., line 1 to p. 137, left lower col., line 8 | p. 36, right upper col., line 12 to p. 37, left upper col., line 19 | p. 4, line 30 to p. 5, line 23, p. 29, line 1 to p. 45, line 25, p. 45, lines 33 to 40, p. 65, lines 2 to 21 |
| High boiling point and/or low boiling point organic solvent | p. 137, left lower col., line 9 to p. 144, right upper col., last line | p. 35, right lower col., line 14 to p. 36, left upper col., line 4 from the bottom | p. 64, lines 1 to 51 |
| Dispersion method of photographic additives | p. 144, left lower col., line 1 to p. 146, right upper col., line 7 | p. 27, right lower col., line 10 to p. 28, left upper col., last line and p. 35, right lower col., line 12 to p. 36, right upper col., line 7 | p. 63, line 51 to p. 64, line 56 |
| Hardening agent | p. 146, right upper col., line 8 to p. 155, left lower col., line 4 | — | — |
| Developing agent precursor | p. 155, left lower col., line 5 to p. 155, right lower col., line 2 | — | — |
| Development inhibitor-releasing compound | p. 155, right lower col., lines 3 to 9 | — | — |
| Support | p. 155, right lower col., line 19 to p. 156, left upper col., line 14 | p. 38, right upper col., line 18 to p. 39, left upper col., line 3 | p. 66, line 29 to p. 67, line 13 |
| Photographic material layer structure | p. 156, left upper col., line 15 to p. 156, right lower col., line 14 | p. 28, right upper col., lines 1 to 15 | p. 45, lines 41 to 52 |
| Dyestuff | p. 156, right lower col., | p. 38, left upper col., | p. 66, lines 18 to |

-continued

| Photographic Constituent | JP-A-62-215272 | JP-A-2-33144 | EP 0355622A2 |
|---|---|---|---|
| | line 15 to p. 184, right lower col., last line | line 12 to right upper col., line 7 | 22 |
| Color mixing inhibitor | p. 185, left upper col., line 1 to p. 188, right lower col., line 3 | p. 36, right upper col., lines 8 to 11 | p. 64, line 57 to p. 65, line 1 |
| Gradation controlling agent | p. 188, right lower col., lines 4 to 8 | — | — |
| Stain inhibitor | p. 188, right lower col., line 9 to p. 193, right lower col., line 10 | p. 37, left upper col., last line to right lower col., line 13 | p. 65, line 32 to p. 66, line 17 |
| Surface active agent | p. 201, left lower col., line 1 to p. 210, right upper col., last line | p. 18, right upper col., line 1 to p. 24, right lower col., last line and p. 27, left lower col., line 10 from the bottom to right lower col., line 9 | — |
| Fluorine-contaning compound (antistatic agent, coating aid, lubricant, adhesion-preventing agent) | p. 210, left lower col., line 1 to p. 222, left lower col., line 5 | p. 25, left upper col., line 1 to p. 27, right lower col., line 9 | — |
| Binder (hydrophilic colloid) | p. 222, left lower col., line 6 to p. 225, left upper col., last line | p. 38, right upper col., lines 8 to 18 | p. 66, lines 23 to 28 |
| Thickener | p. 225, right upper col., line 1 to p. 227, right upper col., line 2 | — | — |
| Antistatic agent | p. 227, right upper col., line 3 to p. 230, left upper col., line 1 | — | — |
| Polymer latex | p. 230, left upper col., line 2 to p. 239, last line | — | — |
| Matting agent | p. 240, left upper col., line 1 to p. 240, right upper col., last line | — | — |
| Photographic processing (processing steps and additives) | p. 3, right upper col., line 7 to p. 10, right upper col., line 5 | p. 39, left upper col., line 4 to p. 42, left upper col., last line | p. 67, line 14 to p. 69, line 28 |

Note) The disclosure of JP-A-62-215272 referred to herein includes the amendments in the written revision filed on March 16, 1987 which is attached to the end of the publication.
Among color couplers, as the yellow coupler, so-called shortwave-type yellow couplers described in JP-A-63-231451, JP-A-63-123047, JP-A-63-241547, JP-A-1-173499, JP-A-1-213648 and JP-A-1-250944 are also preferably used.

As the cyan coupler, in addition to diphenyl-imidazole-based cyan couplers described in JP-A-2-33144, 3-hydroxypyridine-based cyan couplers described in EP 0333185A2 (among couplers described as specific examples therein, Coupler (42) where a four-equivalent coupler is forced to have a chlorine releasing group to convert into a two-equivalent coupler, Couplers (6) and (9) are preferred), cyclic active methylene-based cyan couplers described in JP-A-64-32260 (among those described as specific examples, Couplers 3, 8 and 34 are preferred), pyrrolopyrazole-type cyan couplers described in EP 0456226A1, pyrroloimidazole-type cyan couplers described in EP 0484909 and pyrrolotriazole-type cyan couplers described in EP 0488248 and EP 0491197A1 are preferably used. Among these, particularly preferred are pyrrolotriazole-type cyan couplers.

As the yellow coupler, in addition to the compounds described in the table above, acylacetamide-type yellow couplers with the acyl group having a 3-, 4- or 5-membered cyclic structure described in EP 0447969A1, malondianilide-type yellow couplers having a cyclic structure described in EP 0482552A1 and acylacetamide-type yellow couplers having a dioxane structure described in U.S. Pat. No. 5,118,599 are preferably used. Among these, preferred are acylacetamide-type yellow couplers with the acyl group being 1-alkylcyclopropane-1-carbonyl group and malondianilide-type yellow couplers with one of anilides constituting the indoline ring. These couplers may be used individually or in combination.

As the magenta coupler for use in the present invention, 5-pyrazolone-base magenta couplers or pyrazoloazole-base magenta couplers as described in publications set froth in the table above may be used and among these preferred in view of color hue and image stability or color forming property are pyrazolotriazole couplers having a secondary or tertiary alkyl group bonded directly to the 2-, 3- or 6-position of the pyrazolotriazole ring described in JP-A-61-65245, pyrazoloazole couplers having a sulfonamide group in the molecule described in JP-A-61-65246, pyrazoloazole couplers having an alkoxyphenylsulfonamido ballast group described in JP-A-61-147254 and pyrazoloazole couplers having an alkoxy group or an aryloxy group at the 6-position described in European Patents 226,849A and 294,785A.

With respect to the processing method of the color photographic material of the present invention, in addition to the methods described in the table above, processing materials and processing methods described in JP-A-2-207250, from page 26, right lower column, line 1 to page 34, right upper column, line 9 and JP-A-4-97355, from page 5, left upper column, line 17 to page 18, right lower column, line 20 are preferred.

The color developer used in the present invention preferably contains an organic preservative in place of hydroxylamine or sulfite ion.

The organic preservative as used herein means organic compounds at large capable of reducing the deterioration rate of the aromatic primary amine color developing agent when introduced into the processing solution of a color photographic material. In other words, it includes organic compounds having a function of preventing oxidation of the color developing agent due to an air or the like. Among these, particularly effective organic preservatives include hydroxylamine derivatives (exclusive of hydroxylamine), hydroxamic acids, hydrazines, hydrazides, α-amino acids, phenols, α-hydroxy ketones, α-amino ketones, saccharides, monoamines, diamines, polyamines, quaternary ammonium salts, nitroxy radicals, alcohols, oximes, diamide compounds and condensed ring-type amines. These are described in JP-B-48-30496, JP-A-52-143020, JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-1-97953, JP-A-1-186939, JP-A-1-186940, JP-A-1-187557, JP-A-2-306244 and EP 0530921A1. Other preservatives, which can be used, if desired, include various metals described in JP-A-57-44148 and JP-A-57-53749, salicylic acids described in JP-A-59-180588, amines described in JP-A-63-239447, JP-A-63-128340, JP-A-1-186939 and JP-A-1-187557, alkanolamines described in JP-A-54-3532, polyethyleneimines described in JP-A-56-94349, and aromatic polyhydroxy compounds described in U.S. Pat. No. 3,746,544. Among these, particularly preferred are alkanolamines such as triethanolamine, dialkylhydroxylamines such as N,N-diethylhydroxylamine and N,N-di(sulfoethyl)hydroxylamine, α-amino acid derivatives such as glycine, alanine, leucine, serine, threonine, valine and isoleucine, and aromatic polyhydroxy compounds represented by sodium catechol-3,5-disulfonate.

It is particularly preferred in view of improvement in stability of the color developer and as a result, improvement in stability during a continuous processing to use a dialkylhydroxylamine in combination with an alkanolamine or to use a dialkylhydroxylamine described in EP 0530921A1 in combination with an α-amino acid represented by glycine and an alkanol amine.

The addition amount of the organic preservative may suffice if a function for preventing deterioration of the color developing agent is provided and it is preferably from 0.01 to 1.0 mole/liter, more preferably from 0.3 to 0.30 mole/liter.

The photographic material using the silver halide emulsion of the present invention is favored with excellent effects such that fogging is low, photographic sensitivity is high and rapid processing is possible.

The present invention will be described below in greater detail by referring to the examples but the present invention should not be construed as being limited thereto.

EXAMPLE 1

A silver halide emulsion was prepared as follows.

Preparation of Silver Chloride Emulsion A

An aqueous gelatin solution (containing 1,200 ml of water, 6 g of a deionized alkali-treated gelatin and 0.5 g of NaCl and having a pH of 9.0) was placed in a reaction vessel, the temperature was set to 65° C. and an $AgNO_3$ solution ($AgNO_3$: 0.1 g/ml) and an NaCl solution (NaCl: 0.0345 g/ml) were added thereto by a double jet process over 12 minutes at 15 ml/min. Then, an aqueous gelatin solution (containing 100 ml of water, 19 g of a deionized alkali-treated gelatin and 1.3 g of NaCl) was added and also a 1N solution of $HNO_3$ was added to have a pH of 4.0. Thereafter, the temperature was raised to 70° C. and after ripening for 16 minutes, a fine grain emulsion described below was added in an amount of 0.1 mole in terms of silver halide. After ripening for 15 minutes, 0.15 mole of the fine grain emulsion was added and ripened for 15 minutes and this procedure was repeated two times. After ripening for 2 minutes, the temperature was lowered to 45° C., an NaOH solution was added to have a pH of 5.2 and Sensitizing Dyes A and B described below were added thereto each in an amount of $3\times10^{-4}$ mole per mole of silver halide, followed by stirring for 15 minutes. A sedimenting agent was added thereto, the temperature was lowered to 27° C. the pH was adjusted to 4.0 and the emulsion was water-washed by a sedimentation washing method in a usual manner. An aqueous gelatin solution was added thereto, the temperature was raised to 40° C. and the pH and the pCl of the emulsion were adjusted to 6.4 and 2.8, respectively. Then, the temperature was raised to 55° C. and a sulfur sensitizer was added thereto to effect optimal chemical sensitization.

The thus-prepared emulsion was observed through an electron microscope (TEM) and found to comprise tabular grains having {100} planes as the main planes at a proportion of 80% of the total silver halide grains, in which the average grain size was 1.4 μm, the average aspect ratio was 6.5 and the average grain volume was 0.33 $\mu m^3$.

A fine grain emulsion was prepared as follows. An aqueous gelatin solution (containing 1,200 ml of water, 24 g of gelatin (M3) having an average molecular weight of 30,000 and 0.5 g of NaCl and having a pH of 3.0) was placed in a reaction vessel and thereto, while stirring at a temperature of 23° C., an $AgNO_3$ solution (containing 0.2 mg/ml of $AgNO_3$, 0.01 g/ml of M3 and 0.25 ml/100 ml of $HNO_3$·1N solution) and an NaCl solution (containing 0.07 g/ml of NaCl, 0.01 g/ml of M3 and 0.25 ml/100 ml of KOH·1N solution) were added by a double jet process at 90 ml/min over 3 minutes and 30 seconds. After 1-minute stirring, the pH and the pCl were adjusted to 4.0 and 1.7, respectively.

Preparation of Silver Chloride Emulsions B to D

Emulsions were prepared in the same manner as Silver Chloride Emulsion A except that compounds shown in Table 6 each was previously added immediately before adding 0.15 mole of a fine grain emulsion at the final stage and designated as Silver Chloride Emulsions B to D.

Emulsions B to D each was observed through an electron microscope and found to comprise tabular grains having {100} planes as the main planes at a of the proportion of 40% of the projected area of all silver halide grains, in which at least one corner of the right-angled parallelogram was defective, the average grain size was 1.4 μm, the average aspect ratio was 6.5 and the average grain volume was 0.33 $\mu m^3$.

Preparation of Silver Chlorobromide Emulsion E

An aqueous gelatin solution (containing 1,200 ml of water, 20 g of a deionized alkali-treated gelatin (hereinafter referred to as "EA-Gel") and 0.8 g of NaCl and having a pH of 6.0) was placed in a reaction vessel and thereto Ag-1 Solution and X-1 Solution were added at a temperature of 60° C. while stirring by a double jet process at 50 ml/min over 15 seconds.

Ag-1 Solution contained 20 g of $AgNO_3$, 0.6 g of a low molecular weight gelatin (hereinafter referred to as "M2-Gel") having an average molecular weight of 20,000 and 0.2 ml of $HNO_3$·1N solution in 100 ml of water and X-1 Solution contained 7 g of NaCl and 0.6 g of M2-Gel in 100 ml of water.

Then, Ag-2 Solution (containing 4 g of $AgNO_3$, 0.6 g of M2-Gel and 0.2 ml of $HNO_3$·N solution in 100 ml of water)

and X-2 Solution (containing 2.8 g of KBr and 0.6 g of M2-gel in 100 ml of water) were added by a double jet process at 70 ml/min over 15 seconds. Thereafter, Ag-1 Solution and X-1 Solution were added by a double jet process at 25 ml/min over 2 minutes. Then, 15 ml of a NaCl (0.1 g/ml) solution was added thereto, the temperature was raised to 70° C. and after ripening for 5 minutes, Ag-1 Solution and X-1 were added thereto at 10 ml/min over 15 minutes by a double jet process. Then, to grow tabular grains, an AgCl fine grain emulsion comprising grains having an average grain size of 0.07 μm and free of twins or screw dislocations at a proportion of 99.9% or more was added in an amount of 0.2 mole and ripened for 15 minutes. The temperature was lowered to 40° C., the pH was adjusted to 2.0 and after stirring for 20 minutes, the pH was adjusted to 5.2, followed by stirring for 5 minutes. Then, Sensitizing Dyes A and B described below were added each in an amount of $3\times10^{-4}$ mole per mole of silver halide, a sedimenting agent was added and the emulsion was water-washed in a usual manner. The resulting emulsion was subjected to an optimal chemical sensitization using a sulfur sensitizer and gold sensitizer. The thus obtained emulsion was observed through an electron microscope and found to comprise tabular grains having {100} planes in the form of a right-angled parallelogram as the main planes and an aspect ratio of 3 or more at the proportion of 80% of the projected area of the total silver halide grains, in which the average grain size was 1.35 μm, the average aspect ratio was 6.5 and the average grain volume was 0.32 $\mu m^3$.

Preparation of Silver Chloride Emulsion I

Silver Chloride Emulsion I was prepared in the same formulation and procedure as Silver Chlorobromide Emulsion E except for replacing X-2 Solution by X-3 Solution (containing 11.3 g of NaCl, 0.3 g of KI and 0.6 g of M2-Gel in 100 ml of water).

Emulsion I was observed through an electron microscope and found to comprise tabular grains having {100}planes in the form of a right-angled parallelogram as the main planes and an aspect ratio of 3 or more at the proportion of 60% of the projected area of all silver halide grains, in which the average grain size was 1.45 μm, the average aspect ratio was 7.5 and the average grain volume was 0.32 $\mu m^3$.

Preparation of Silver Chloride Emulsion J

Silver Chloride Emulsion J was prepared in the same manner as Silver Chloride Emulsion I except for adding the compound shown in Table 6 immediately before adding 0.2 mole of a fine grain emulsion.

Emulsion J was observed through an electron microscope and found to comprise tabular grains having {100}planes in the form of a right-angled parallelogram as the main planes and an aspect ratio of 3 or more at the proportion of 28% of the projected area of all silver halide grains, in which the average grain size was 1.45 μm, the average aspect ratio was 7.5 and the average grain volume was 0.32 $\mu m^3$.

The thus-prepared Silver Chloride or Silver Chlorobromide Emulsions A to J are described in summary in Table 6.

TABLE 6

| Emulsion | Compound Added | Addition Amount*) (mole/mole of silver halide) | Silver Chloride Content (%) | Proportion**) of Tabular Grains having {100} Planes | Aspect Ratio |
|---|---|---|---|---|---|
| A | — | — | 100 | 80 | 6.5 |
| B | Compound (5) | $4.0\times10^{-4}$ | " | 80 (40) | " |
| C | Compound (11) | " | " | 80 (40) | " |
| D | Compound (12) | " | " | 80 (40) | " |
| E | — | — | 98.4 | 80 | " |
| F | Compound (11) | $1.8\times10^{-4}$ | " | 80 (34) | " |
| G | " | $3.6\times10^{-4}$ | " | 80 (34) | " |
| H | " | $7.2\times10^{-4}$ | " | 80 (34) | " |
| I | — | — | 98.7 | 60 | 7.5 |
| J | Compound (11) | $3.6\times10^{-4}$ | " | 60 (28) | " |

*Addition amount is per mole of silver halide of the final silver halide grains

*The numerals in parentheses are the proportion of tabular grains having {100} planes as the main planes which is in the form of right-angled parallelogram with at least one corner being defective.

Preparation of Silver Chlorobromide Emulsions F to H

Emulsions were prepared in the same manner as Silver Chlorobromide Emulsion E except that compounds shown in Table 6 each was previously added immediately before adding 0.2 mole of a fine grain emulsion and designated as Silver Chlorobromide Emulsions F to H. Emulsions F to H each was observed through an electron microscope and found to comprise tabular grains having {100} planes in the form of a right-angled parallelogram as the main planes and an aspect ratio of 3 or more at a proportion of 34% of the projected area of all silver halide grains, in which at least one corner was defective, the average grain size was 1.35 μm, the average aspect ratio was 6.5 and the average grain volume was 0.32 $\mu m^3$.

Then, a multi-layer color printing paper (Sample 1) having the following layer construction was prepared by subjecting the surface of a paper support of which both surfaces are laminated by polyethylene to corona discharge treatment, providing thereon a gelatin undercoat layer containing sodium dodecylbenzene sulfonate and coating thereon various photographic constituent layers.

Preparation of Coating Solution for the First Layer 180.0 ml of ethyl acetate, 24.0 g of Solvent (solv-1) and 24.0 g of Solvent (solv-2) were added to 153.0 g of Yellow Coupler (ExY), 15.0 g of Dye Image Stabilizer (Cad-1), 7.5 g of Dye Image Stabilizer (Cad-2) and 15.8 g of Dye Image Stabilizer (Cad-3) and the resulting solution was dispersed in 60.0 ml of a 10% sodium dodecylbenzene sulfonate and 560 ml of a 18% aqueous gelatin solution containing 10 g of citric acid to prepare Emulsified Dispersion A.

The above-described Silver Chlorobromide Emulsin K and this Emulsified Dispersion A were mixed and dissolved to prepare a coating solution for the first layer having the composition described below.

The coating solutions for the second to seventh layers each was prepared in the same manner as the coating solution for the first layer. In each layer, 1-oxy-3,5-dichloro-s-triazine sodium salt was used as a gelatin hardener.

Further, Cpd-15 and Cpd-16 were added to each layer to give the total amount of 25.0 mg/m$^2$ and 50 mg/m$^2$, respectively.

In the silver chlorobromide emulsion of each light-sensitive emulsion layer, the following spectral sensitizing dyes were used.

TABLE 7

Blue-Sensitive Emulsion Layer

Sensitizing Dye A

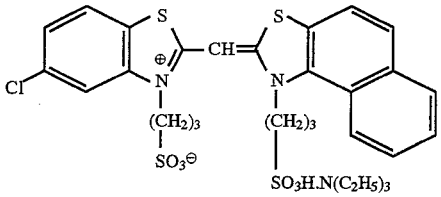

and

TABLE 7-continued

Blue-Sensitive Emulsion Layer

Sensitizing Dye B

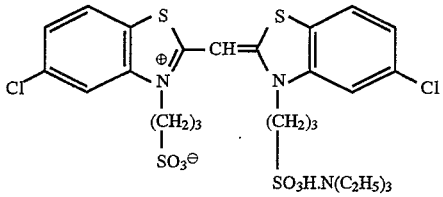

TABLE 8

Green-sensitive Emulsion Layer

Sensitizing Dye C

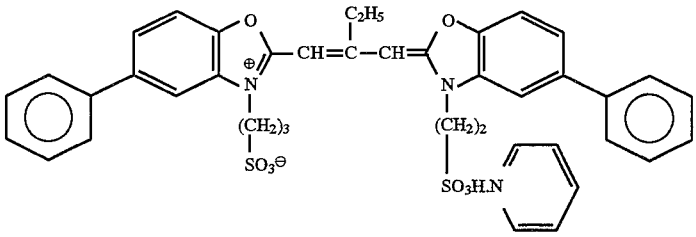

(added in an amount of $4.0 \times 10^{-4}$ mole to a large-sized emulsion and $5.6 \times 10^{-4}$ mole to a small-sized emulsion, per mole of silver halide) and Sensitizing Dye D

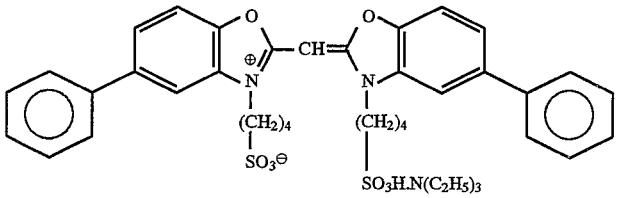

(added in an amount of $7.0 \times 10^{-5}$ mole to a large-sized emulsion and $1.0 \times 10^{-4}$ mole to a small-sized emulsion, per mole of silver halide).

TABLE 9

Red-Sensitive Emulsion Layer

Sensitizing Dye E

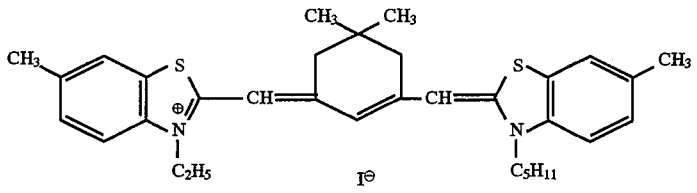

(added in an amount of $0.9 \times 10^{-4}$ to a large-sized emulsion and $1.1 \times 10^{-4}$ mole to a small-sized emulsion, per mole of silver halide).

Further, the following compound was added in an amount of $2.6\times10^{-3}$ mole per mole of silver halide.

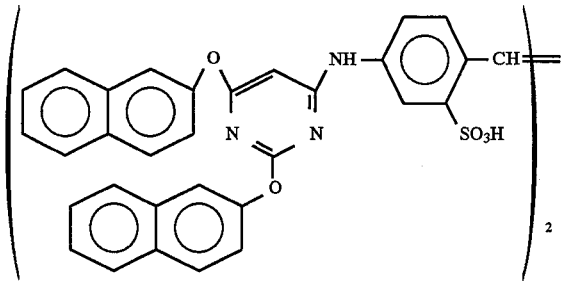

1-(5-Methylureidophenyl)-5-mercaptotetrazole was added to the green-sensitive emulsion layer and the red-sensitive emulsion layer in an amount of $7.7\times10^{-4}$ mole and $3.5\times10^{-4}$ mole per mole of silver hlaide, respectively. 4-Hydroxy-6-methyl-1,3,3a,7-tetraazaindene was added to the blue-sensitive emulsion layer, the green-sensitive emulsion layer and the red-sensitive emulsion layer in an amount of $1\times10^{-4}$ mole, $2\times10^{-4}$ mole and $1.5\times10^{-4}$ mole, per mole of silver halide, respectively.

For the purpose of prevention of irradiation, the following dyes (the coating amount is shown in the parenthesis) were added to the emulsion layers.

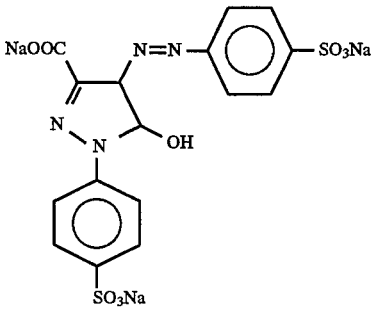

(10mg/m²)

-continued

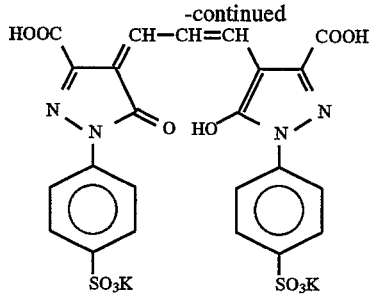

(10mg/m²)

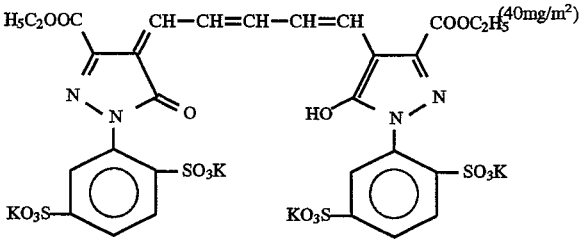

(40mg/m²)

and

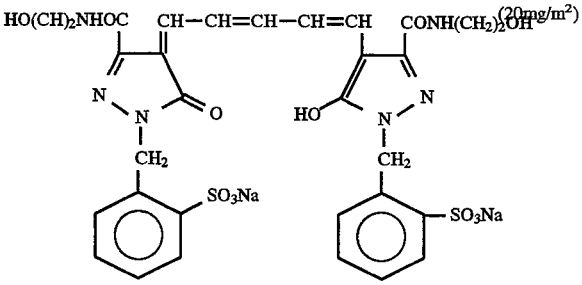

(20mg/m²)

(Layer Structure)

The composition of each layer is described below. The numerals show the coating amounts (g/m²). In the case of a silver halide emulsion, it is shown in terms of silver coated amount.

Support

Polyethylene laminated paper (containing a white pigment ($TiO_2$ content: 15 wt %) and a bluish dye (ultramarine) in the polyethylene on the first layer side).

| | |
|---|---|
| First Layer (Blue-sensitive Emulsion Layer) | |
| Silver Chloride Emulsion K | 0.27 |
| Gelatin | 1.36 |
| Yellow Coupler (EXY) | 0.79 |
| Dye Image Stabilizer (Cpd-1) | 0.08 |
| Dye Image Stabilizer (Cpd-2) | 0.04 |
| Dye Image Stabilizer (Cpd-3) | 0.08 |
| Solvent (Solv-1) | 0.13 |
| Solvent (Solv-2) | 0.13 |
| Second Layer (Color Mixing Preventing Layer) | |
| Gelatin | 1.00 |
| Color Mixing Inhibitor (Cpd-4) | 0.06 |
| Dye Image Stabilizer (Cpd-5) | 0.02 |
| Solvent (Solv-2) | 0.20 |
| Solvent (Solv-3) | 0.30 |
| Third Layer (Green-sensitive Emulsion Layer) | |
| Silver Chlorobromide Emulsion (cubic, a 1:3 (by mole as silver) mixture of Large-sized Emulsion G1 having an average grain size of 0.45 μm and Small sized Emulsion G2 having an average grain size of 0.29 μm, comprising silver hlaide grains having a coefficient of fluctuation in the grain size distribution of 0.08 and 0.10, respectively, in which 0.8 mole % of silver bromide was localized on a part of the surface of a silver halide grain in the emulsions of each size and the remaining was silver chloride) | 0.13 |
| Gelatin | 1.50 |
| Magenta Coupler (EXM) | 0.16 |
| Dye Image Stabilizer (Cpd-2) | 0.03 |
| Dye Image Stabilizer (Cpd-6) | 0.15 |
| Dye Image Stabilizer (Cpd-7) | 0.01 |
| Dye Image Stabilizer (Cpd-8) | 0.02 |
| Dye Image Stabilizer (Cpd-9) | 0.07 |
| Solvent (Solv-3) | 0.50 |
| Solvent (Solv-4) | 0.15 |
| Solvent (Solv-5) | 0.15 |
| Fourth Layer (Color Mixing Preventing Layer) | |
| Gelatin | 0.70 |
| Color Mixing Inhibitor (Cpd-4) | 0.04 |
| Dye Image Stabilizer (Cpd-5) | 0.02 |

-continued

| | |
|---|---|
| Solvent (Solv-2) | 0.18 |
| Solvent (Solv-3) | 0.18 |
| Solvent (Solv-7) | 0.02 |
| Fifth Layer (Red-sensitive Emulsion Layer) | |
| Silver Chlorobromide Emulsion (cubic, a 8:2 (molar ratio) mixture of Large-sized Emulsion R1 having an average grain size of 0.5 μm and Small-sized Emulsin R2 having an average grain size of 0.4 μm, comprising silver halide grains having a coefficient of fluctuation in the grain size distribution of 0.09 and 0.10, respectively, in which 0.8 mole % of silver bromide was localized on a part of a silver halide grain in the emulsions of each size and the remaining was silver chloride) | 0.20 |
| Gelatin | 0.85 |
| Cyan Coupler (EXC) | 0.33 |
| Ultraviolet Absorbent (UV-2) | 0.18 |
| Dye Image Stabilizer (Cpd-1) | 0.33 |
| Dye Image Stabilizer (Cpd-8) | 0.01 |
| Dye Image Stabilizer (Cpd-9) | 0.01 |
| Dye Image Stabilizer (Cpd-10) | 0.16 |
| Dye Image Stabilizer (Cpd-11) | 0.14 |
| Dye Image Stabilizer (Cpd-12) | 0.01 |
| Solvent (Solv-1) | 0.01 |
| Solvent (Solv-6) | 0.22 |
| Sixth Layer (Ultraviolet Absorbing Layer) | |
| Gelatin | 0.55 |
| Ultraviolet Absorbent (UV-1) | 0.38 |
| Dye Image Stabilizer (Cpd-13) | 0.15 |
| Dye Image Stabilizer (Cpd-6) | 0.02 |
| Seventh Layer (Protective Layer) | |
| Gelatin | 1.13 |
| Acryl-modified copolymer of polyvinyl alcohol (modification degree: 17%) | 0.05 |
| Liquid paraffin | 0.02 |
| Dye Image Stabilizer (Cpd-14) | 0.01 |

The compounds used here are shown below.

Yellow Coupler (ExY)

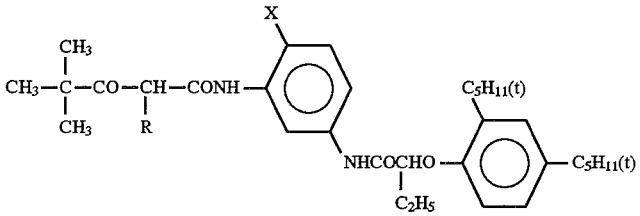

A 1:1 (by mole) mixture of

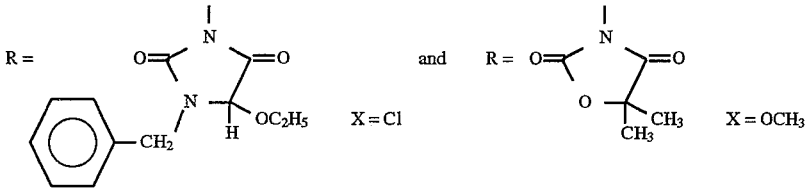

-continued

Magenta Coupler (ExM)

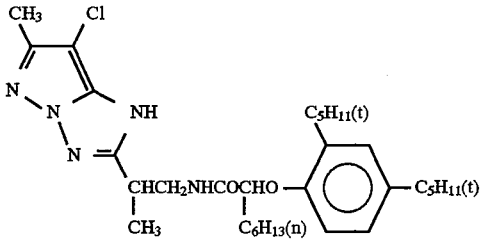

Cyan Coupler (ExC)
A 3:7 (by mole) mixture of

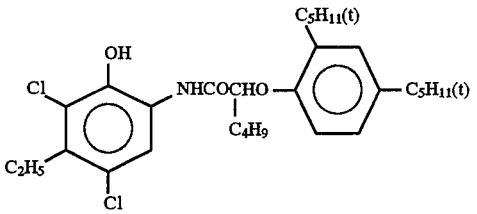

and

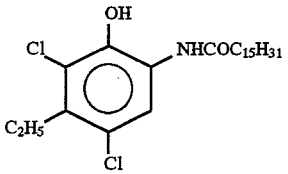

Dye Image Stabilizer (Cpd-1)

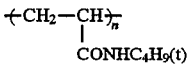

Number average molecular weight: 60,000

Dye Image Stabilizer (Cpd-2)

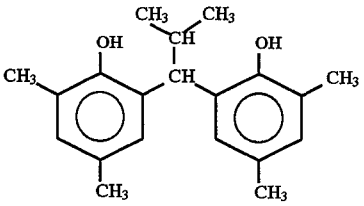

Dye Image Stabilizer (Cpd-3)

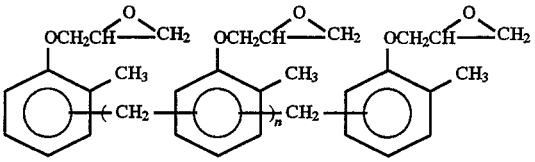

(n = 7 to 8 (on average))

Color Mixing Inhibitor (Cpd-4)

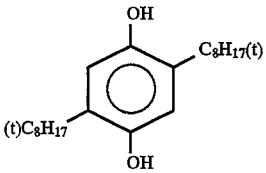

Dye Image Stabilizer (Cpd-5)

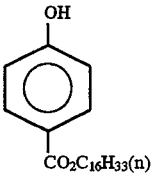

Dye Image Stabilizer (Cpd-6)

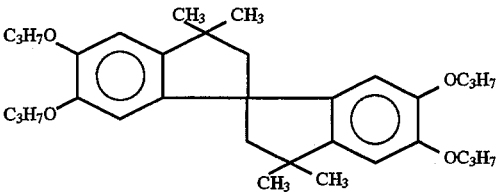

Dye Image Stabilizer (Cpd-7)

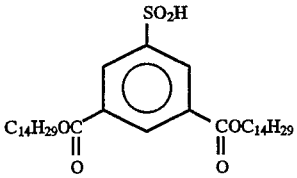

Dye Image Stabilizer (Cpd-8)

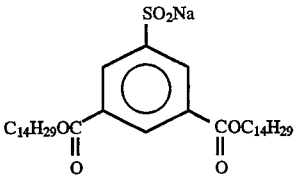

Dye Image Stabilizer (Cpd-9)

Dye Image Stabilizer (Cpd-10)

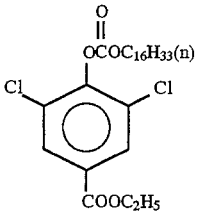
Dye Image Stabilizer (Cpd-11)
-continued
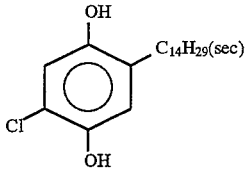
Dye Image Stabilizer (Cpd-12)
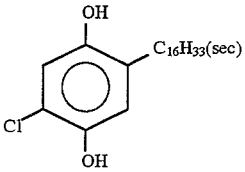
Dye Image Stabilizer (Cpd-13)
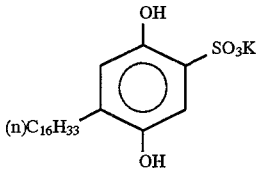
Dye Image Stabilizer (Cpd-14)
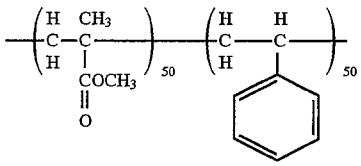
Average molecular weight: about $6.0 \times 10^4$
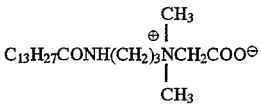
Antiseptic (Cpd-15)
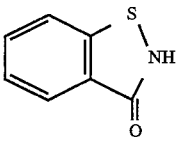
Antiseptic (Cpd-16)
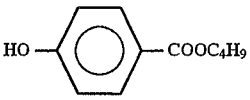
Ultraviolet Absorbent (UV-1)
A 1:5:10:5 (by weight) mixture of (1), (2), (3) and (4):
(1)
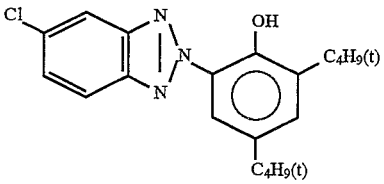
(2)
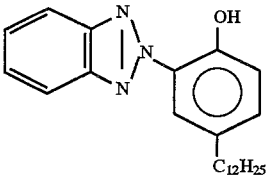
(3)
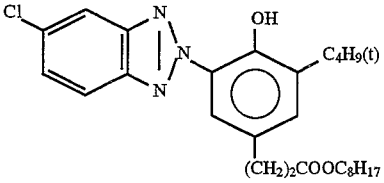
(4)
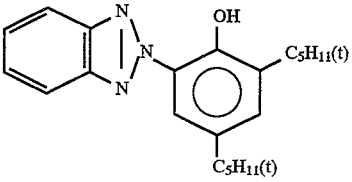
Ultraviolet Absorbent (UV-2)
A 1:2:2 (by weight) mixture of (1), (2) and (3).

(1)

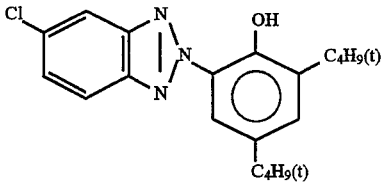

-continued (2)

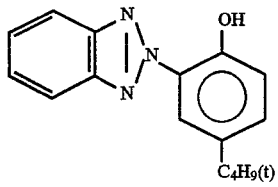

(3)

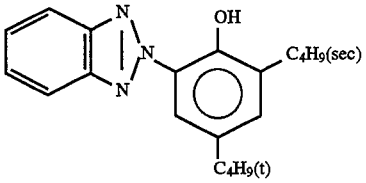

Solvent (Solv-1)

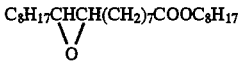

Solvent (Solv-2)

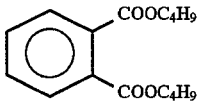

Solvent (Solv-3)

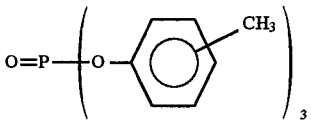

Solvent (Solv-4)

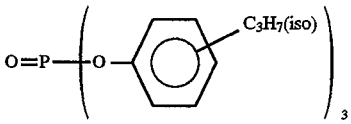

Solvent (Solv-5)

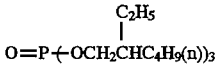

Solvent (Solv-6)

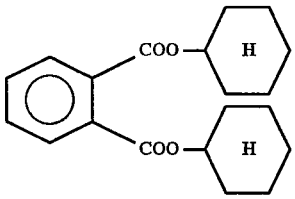

Solvent (Solv-7)

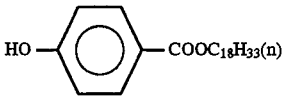

Samples different from Sample 1 prepared above in the kinds of silver chloride and silver chlorobromide in the first layer (blue-sensitive emulsion layer), shown in Table were prepared.

TABLE 10

| Sample | Emulsion | Sensitivity | Fogging | Remarks |
|---|---|---|---|---|
| 1 | A | 100 | 0.15 | Comparison |
| 2 | B | 125 | 0.07 | Invention |
| 3 | C | 130 | 0.05 | " |
| 4 | D | 120 | 0.06 | " |
| 5 | E | 105 | 0.20 | Comparison |
| 6 | F | 150 | 0.09 | Invention |
| 7 | G | 210 | 0.06 | " |
| 8 | H | 215 | 0.07 | " |
| 9 | I | 108 | 0.17 | Comparison |
| 10 | J | 220 | 0.05 | Invention |

Each sample was exposed for 1 second through an optical wedge and a blue filter to examine the sensitivity and then developed through the following steps using the processing solutions described below. The sensitivity was expressed by the exposure amount necessary to give a density 1.0 higher than the fogging density and as a relative value to the sensitivity of Sample 1 taken as 100.

| Procesing Step | Temperature (°C.) | Time (sec.) |
|---|---|---|
| Color development | 35 | 45 |
| Bleach-fixing | 30–35 | 45 |
| Rinsing (1) | 30–35 | 20 |
| Rinsing (2) | 30–35 | 20 |
| Rinsing (3) | 30–35 | 20 |
| Drying | 70–80 | 60 |

Each processing solution had the following composition.

| Color Developer | |
|---|---|
| Water | 800 ml |
| Ethylenediamine-N,N,N,N-tetramethylene phosphonic acid | 1.5 g |
| Potassium bromide | 0.015 g |
| Triethanolamine | 8.0 g |
| Sodium chloride | 1.4 g |
| Potassium carbonate | 25.0 g |
| N-Ethyl-N-(β-methanesulfonamidoethyl)-3-methyl-4-aminoaniline sulfate | 5.0 g |
| N,N-Bis(carboxymethyl)hydrazine | 4.0 g |
| N,N-Di(sulfoethyl)hydroxylamine.1Na | 4.0 g |
| Fluorescent brightening agent (WHITEX 4B produced by Sumitomo Chemical Co., Ltd.) | 1.0 g |
| Water to make | 1,000 ml |
| pH (25° C.) | 10.05 |

| Bleach-fixing Solution | |
|---|---|
| Water | 400 ml |
| Ammonium thiosulfate (70%) | 100 ml |
| Sodium sulfite | 17 g |
| Ammonium ethylenediaminetetraacetate Fe(III) | 55 g |
| Disodium ethylenediaminetetraacetate | 5 g |
| Amonium bromide | 40 g |
| Water to make | 1,000 ml |
| pH (25° C.) | 6.0 |

Rinsing Solution

Ion Exchange Water (calcium and magnesium content each being 3 ppm)

As is clearly seen from the results of Table 10, The grain having {100} planes as the main planes in the form of a right-angled parallelogram was fogged when it was subjected to chemical sensitization. In particular, when gold sensitization was effected in combination, the increase in fogging was conspicuous and the sensitivity was not high. The fogging could be remarkably improved when the right-angled parallelogram of the {100} plane as the main planes of the grain was made asymmetrically defective at four corners and the grain could have high sensitivity.

EXAMPLE 2

Samples prepared in Example 1 were processed through the following steps using the processing solutions described below and subjected to the same evaluation as in Example 1. As a result, the effect of the present invention was confirmed the same as in Example 1.

| Procesing Step | Temperature (°C.) | Time (sec.) |
|---|---|---|
| Color development | 35 | 45 |
| Bleach-fixing | 35 | 45 |
| Stabilization (1) | 35 | 20 |
| Stabilization (2) | 35 | 20 |
| Stabilization (3) | 35 | 20 |
| Stabilization (4) | 35 | 20 |
| Drying | 80 | 60 |

Each processing solution had the following composition.

| Color Developer | |
|---|---|
| Water | 800 ml |
| Lithium polystyrenesulfonate solution (30%) | 0.25 ml |
| 1-Hydroxyethylidene-1,1-diphosphonic acid solution (60%) | 0.8 ml |
| Lithium sulfate (anhydrous) | 2.7 g |
| Triethanolamine | 8.0 g |
| Potassium chloride | 1.8 g |
| Potassium bromide | 0.03 g |
| Diethylhydroxylamine | 4.6 g |
| Glycine | 5.2 g |
| Threonine | 4.1 g |
| Potassium carbonate | 27.0 g |
| Potassium sulfite | 0.1 g |
| N-Ethyl-N-(β-methanesulfonamidoethyl)-3-methyl-4-aminoaniline. ⅔ sulfate monohydrate | 4.5 g |
| Fluorescent brightening agent (4',4'-diaminostilbene-based) | 2.0 g |
| Water to make | 1,000 ml |
| pH (25° C.) (adjusted by potassium hydroxide and sulfuric acid) | 10.12 |
| Bleach-fixing Solution | |
| Water | 400 ml |
| Ammonium thiosulfate (700 g/liter) | 100 ml |
| Sodium sulfite | 17 g |
| Ammonium ethylenediaminetetraacetate | 55 g |
| Disodium ethylenediaminetetraacetate | 5 g |
| Glacial acetic acid | 9 g |
| Water to make | 1,000 ml |
| pH (25° C.) (adjusted by acetic acid and ammonia) | 5.40 |
| Stabilizer | |
| 1,2-Benzoisothiazoline-3-one | 0.02 g |
| Polyvinyl pyrrolidone | 0.05 g |
| Water to make | 1,000 ml |
| pH (25° C.) | 7.0 |

(Reference)

The relation between the ratio of the {100} plane and the fogging is described below.

Silver halide emulsions were prepared as follows.

| | | |
|---|---|---|
| Solution 1 | Inert gelatin | 25 g |
| | NaCl | 4.5 g |
| | $H_2SO_4$ (1N) | 18 ml |
| | $H_2O$ | 1,000 ml |
| Solution 2 | $AgNO_3$ | 5 g |
| | $H_2O$ to make | 140 ml |
| Solution 3 | NaCl | 1.7 g |
| | $H_2O$ to make | 140 ml |
| Solution 4 | $AgNO_3$ | 120 g |
| | $H_2O$ to make | 320 ml |
| Solution 5 | NaCl | 42 g |
| | $H_2O$ to make | 320 ml |

Solution 2 and Solution 3 were simultaneously added to Solution 1 kept at 40° C. while vigorously stirring over 40 minutes.

Further, Solution 4 and Solution 5 were simultaneously added thereto over 60 minutes. During the addition of Solution 4 and Solution 5, Compound I of the present invention was added thereto in an amount of 0.5 g.

5 Minutes after the completion of the addition of Solution 4 and Solution 5, the temperature was lowered to 35° C. and soluble salts were removed by sedimentation in a usual manner and then, the temperature was again raised to 40° C., gelatin was additionally added to dissolve and sodium chloride and phenol were added to adjust the pH to 6.5.

The emulsions prepared without adding the compound of the present invention was cubic but the emulsions prepared while adding Compound (11) included in the present invention comprised tetradecahedral grains (octahedron) different in the proportion of {100} planes according to the time when Compound (11) was added after Solution 4 and Solution 5 were added.

To each of the resulting emulsions, sodium thiosulfate was added in an amount of $3.5\times10^{-5}$ mole per mole of silver halide to effect chemical sensitization at 60° C.

Gelatin and sodium dodecylbenzene sulfonate were added to each of the emulsions and the emulsion and a protective layer containing gelatin, polymethyl methacrylate particles and 2,4-dichloro-6-hydroxy-s-triazine sodium salt were coated on a triacetyl cellulose film support having an undercoat layer by co-extrusion to have a silver coverage of 2 $g/m^2$ in each layer to prepare coated samples.

Each sample was subjected to exposure for sensitometry (1 second) through an optical wedge and developed with Metol and ascorbic acid developer formulated as below at 20° C. for 5 minutes, followed by stopping, fixing, water washing and drying in a usual manner and the optical density was measured.

The fogging was determined from the minimum optical density of samples and the results are shown in FIG. 2.

| Metol Ascorbic Acid Developer | |
|---|---|
| Metol | 2.5 g |
| L-Ascorbic acid | 10.0 g |
| NABOX | 35.0 g |
| NaCl | 0.58 g |
| Water to make | 1 l |

While the invention has been described in detail and with reference to specific embodiments thereof, it will be apparent to one skilled in the art that various changes and modifications can be made therein without departing from the spirit and scope thereof.

What is claimed is:

1. A method of preparing a silver halide emulsion containing tabular silver halide grains having a silver chloride content of 80 mole % or more, and having {100} planes as the main planes and an aspect ratio of 1.5 or more;

wherein said main planes in the form of a right-angled parallelogram are defective in at least one corner thereof, and said tabular silver halide grains comprise at least 10% of the total projected area of the grains; and wherein said tabular silver halide grains are produced by adding during grain formation at least one grain growth modifier represented by formula (I) or (II):

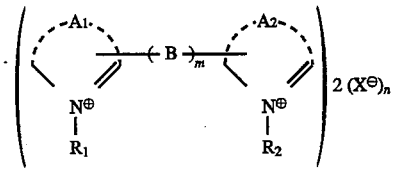

(I)

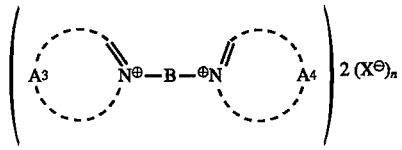

(II)

wherein $A_1$, $A_2$, $A_3$, and $A_4$, which may be the same or different, each represents a nonmetallic atom group necessary for forming a nitrogen-containing hetero ring, B represents a divalent linking group, m represents 0 or 1, $R_1$ and $R_2$ each represents an alkyl group, X represents an anion, n represents 0 or 1 and when an intramolecular salt is formed, n is 0; in an amount of from 50 to 90 mole % based on the amount of silver used for grain formation.

* * * * *